US005566531A

United States Patent [19]

Nordstrom et al.

[11] Patent Number: 5,566,531

[45] Date of Patent: Oct. 22, 1996

[54] NAPKIN WRAPPING MACHINE AND METHOD FOR WRAPPING NAPKINS

[75] Inventors: John E. Nordstrom, Manitowoc; Christopher J. Rusch, Two Rivers, both of Wis.

[73] Assignees: John E. Nordstrom; Barbara A. Nordstrom, both of Two Rivers, Wis.; part interest to each

[21] Appl. No.: 237,795

[22] Filed: May 4, 1994

Related U.S. Application Data

[63] Continuation-in-part of Ser. No. 914,679, Jul. 15, 1992, abandoned.

[51] Int. Cl.[6] ..... B65B 7/00; B65B 11/00; B65B 51/00

[52] U.S. Cl. ..... 53/466; 53/463; 53/228; 53/233; 53/387.3; 53/375.9; 53/376.2

[58] Field of Search ..... 53/228, 233, 466, 53/586, 375.9, 376.2, 387.2, 463, 477, 232, 387.3, 376.7, 377.2, 377.8, 378.3

[56] References Cited

U.S. PATENT DOCUMENTS 2,486,892 11/1949 Sumida ..... 53/387.3 X
3,618,740 11/1971 Taverna ..... 53/228 X
4,624,096 11/1986 Nordstrom ..... 53/228 X
4,881,357 11/1989 Ballestrazzi et al. ..... 53/228 X

FOREIGN PATENT DOCUMENTS 2160843 1/1986 United Kingdom ..... 53/466

*Primary Examiner*—Linda Johnson
*Attorney, Agent, or Firm*—Wheeler Kromholz & Manion

[57] ABSTRACT

A machine and process for wrapping workpieces, typically napkins. The machine having an infeed conveyor from which workpieces are feed to a poly film supply apparatus, via a conveyor assembly, that distributes a predetermined portion of the poly film supply apparatus around the workpieces to form a horizontally disposed U having a first tail and a second tail of poly film wrap. The conveyor assembly has two conveyor belts that are arranged so that the end of the first conveyor belt meets an end of the second conveyor belt. The second conveyor belt is mounted on a pulley system that allows the end of the second conveyor belt to move away from the end of the first conveyor belt after the workpieces have transferred to the second conveyor belt so that a gap between the two belts is presented. A folder folds down the first tail of poly film wrap. A second folder and a sealer bar come up through the gap and fold up the second tail against the first and seal it in place. A tucking mechanism then tucks in the ends of the poly film wrapping material and the ends are sealed by another sealing mechanism thereby wrapping the package of workpieces.

15 Claims, 21 Drawing Sheets

NAPKIN WRAPPING MACHINE AND METHOD FOR WRAPPING NAPKINS

This application is a continuation-in-part, of application Ser. No. 07/914,679 filed Jul. 15, 1992, abandoned.

BACKGROUND OF THE INVENTION

The present invention relates generally to the field of wrapping machines and specifically to napkin wrapping machines. There are a great many wrapping machines that are known in the art. In fact the inventor has made several improvements in the art of wrapping machines and has received several patents on those improvements. For example, U.S. Pat. No. 4,426,825 (Nordstrom), U.S. Pat. No. 5,038,549 (Nordstrom), U.S. Pat. No. 4,624,096 (Nordstrom), and U.S. Pat. No. 5,050,724 (Nordstrom).

However, the inventor knows of no prior art which uses the unique and simple design of the present invention to wrap napkins in a high speed and high efficiency manner. The present invention represents a significant improvement over currently used napkin wrapping machines in that it produces on average less than one percent (1%) scrap. Typically packaging that has to be scrapped is created by the failure to properly seal the polyethylene (poly) film that is normally used to wrap the napkin material. Currently, most machines today average up to thirty percent (30%) scrap. Thus, the present invention is a significant improvement in the art.

Also, many wrapping machines require the product that is to be wrapped to vary in speed as it moves through the machine as various wrapping processes are applied to it. The present invention does not vary the speed at which the product moves through the machine but rather has the wrapping and sealing mechanisms of the machine move at the same relative speed as the packaging so that, even though the packaging is moving at a constant speed through the machine, the functions of sealing and wrapping occur in a relatively stationary environment since the positions of package and the sealing and wrapping mechanisms are essentially stationary relative to each other regardless of the speed of the machine. Thus, constant speed may be maintained per each wrapping and sealing cycle.

Accordingly, it is the objective of this invention to provide a high speed napkin wrapping machine that produces a low level of scrap material, ideally around or less than one percent (1%), while at the same time producing finished wrapped napkin packages at a rate equal to or greater than those machines currently in the marketplace today.

SUMMARY OF THE INVENTION

The present invention applies many of the concepts of the applicant's previously patented structures and also includes a unique sealing station for sealing the back or rear seal of a polyethylene film (hereafter referred to as poly film) wrapper around a group of napkin work pieces.

It should be noted that, while the present invention is directed primarily toward wrapping napkins, other types of workpieces other than napkins may be wrapped using the device of the present invention. For example, plastic garbage bags, paper bags, paper wipes, inter-folded towels, facial tissue, or sheaves of paper, etc. could be wrapped assuming they have the manufacturing characteristics required; e.g. an ability not to melt, or burn when the sealer bar presses against the poly film to melt it to form the seal. Accordingly, the types of workpieces wrapped by the present invention should be construed broadly and not be limited to napkins alone. Also, although apparent from this disclosure, all the timing and actuating mechanisms disclosed herein are powered using standard industrial power supply mechanisms.

The present invention may be generally described as comprising a work piece or product infeed means for feeding the napkins or work pieces that are to be packaged (wrapped in poly film) into the wrapping machine. From the product infeed means the napkins are transferred to a poly wrap feed means for feeding the poly wrap around the napkin product work pieces, after which they are sent on to a sealing station that finishes folding the poly wrap around the napkins so that the tube is formed around the work pieces and then seals the back or rear seam of the poly film that is folded around the napkin work pieces. Therefore, at this stage the poly film forms a generally rectangular tube around the rough cube formed by the stacked napkin workpieces. This forms a rear seam that is sealed by the control seam sealing station. An endfold means for folding in the ends of the tube is used then to fold in the ends of the tube and cover the sides of the napkin workpieces. Finally, a sealing means for sealing the ends of the poly film packaging that have been folded against the sides of the napkin work pieces. The napkins are conveyed through the napkin wrapping machine by means of a series of conveyor belts.

The napkin wrapping machine generally functions as follows:

A group of napkins is placed in the product infeed means and the napkins are fed into the poly wrap feed station where the poly wrap is wrapped around the napkins. This is accomplished by using substantially the same wrapping film supply system as disclosed in U.S. Pat. Nos. 4,624,096 and 4,426,825. The napkin workpieces enter the napkin wrapping machine between an upper and a lower belt. The belts are adjustable with respect to each other and provide just enough room between each other for the stack of napkin workpieces to enter.

After entering the napkin wrapping machine the napkins pass beneath a wrapping film supply section that is fed from a roll of wrapping material from which sheets of wrapping film are cut and supplied to lie in a horizontal plane above the napkins supported by a first conveyor belt. The wrapping film is supplied in specific relationship to the napkins such that an amount of film sufficient to wrap the forward side, the bottom side, and part of the back side of the napkins extends ahead of the product as it moves down the first conveyor belt. The remainder of the predetermined portion of wrapping material extends above and behind the napkins. The wrapper is carried between pairs of belts that move along side the product at the same speed.

The preferred velocity at which all materials, i.e. poly wrap film and napkins, are moved through the machine is 27 inches per cycle. The speed at which the poly wrap film is fed into the machine may be varied in order to vary the size of the wrapper of poly wrap film that is to be wrapped around the napkins. For example cocktail napkins would require a smaller wrapper than dinner napkins. Further, it has been found that the present invention may operate at a rate of approximately 75 cycles per minute on average versus 60 cycles per minute on average for other prior art machines. Consequently, the average increase in rate of product wrapping speed and product production is 25 percent. Accordingly, the device of the present invention provides an increase in the average rate of production speed while at the same time greatly reducing the amount of scrap materials that are produced.

As the napkins and the wrapping film proceed down the conveyor from the wrapping or poly film supply area on the lower wrapper carrying belts a vacuum is turned on and applied to a portion of the belts. The belts are perforated so that the vacuum can pull through the belts so that the edge of the wrapping film is brought downward through a slot ahead of the napkins by engagement with the portion of the belts to which the vacuum is applied. The vacuum should be sufficient to tightly grip the film to prevent wrinkles. As the forward edge moves downwardly it is stripped from the vacuum portion of the belts by the remainder of the belts which nip it lightly and assure its continued travel vertically downward as it leaves the vacuum roll. A large number of belts and rollers in this slot smooth and control the wrapper film. As the napkins (the product) move over the slot area from which the wrapping film was pulled downwardly, the film is pulled taut at the forward edge of the product and is drawn from its downward extension into the slot to cover the bottom surface of the product as the product advances so that the film now extends in a horizontally disposed U from behind the product at the top (the first tail) and around the top, front, bottom, to behind napkins at the bottom (the second tail).

Previous to this point both the film and the product have been conveyed on upper and lower belts but the product now enters the seam sealing station having an upper carriage with paddles (the top folder) that fold the first tail over the back of the product.

As the top poly film tail is folded over the back of the product by the top folder plate, so the poly film covers the top, front, and bottom of the napkin product, the portion of the poly film that extends behind the napkins, the second tail, is folded upward over the upper film tail.

In order to accomplish this step of folding the second tail up over the upper film tail it is necessary to have a gap in the lower conveyor belt of the sealing station. Consequently, the lower conveyor belt must comprise a first conveyor belt assembly and a second conveyor belt assembly that can be separated to present a gap between their closest ends. Both conveyor belts or transport belts are continuous and are timed to advance the napkins at the same rate of speed. Each conveyor belt assembly is comprised of at least two narrow parallel and continuous belts also separated by a gap.

The parallel belts of the second belt assembly are each mounted on a separate 4-pulley system. As will be described in greater detail below the pulley system is designed to allow the pulleys of each belt of the second conveyor belt assembly that are nearest the first conveyor belt assembly to move away from that conveyor belt assembly and present a gap. Normally, such movement or gliding away from the first conveyor belt assembly would result in slack occurring along the second conveyor belt assembly. That slack is taken up by the movement of another pulley in the 4-pulley system. Accordingly, two of the pulleys in the 4-pulley system are fixed and two act as dancer pulleys which move parallel to each other and in tandem with each other in order to present the gap that is required. Thus, as long as two of the dancer pulleys move in tandem to take up the belt slack that is produced, the actual total number of pulleys may vary.

The pulleys are controlled by known control means (e.g. cams) to move in time with the movement of the support carriage that is located underneath the first and second conveyor belt assemblies.

The support carriage is connected via bell cranks to cam followers that ride in cam tracks, located to either side of the support carriage, that time the movement of the support carriage in relationship to the movement of the other parts of the machine. In this manner the timing and movement of the support carriage in relationship to the movement of the napkins or product is controlled. Please note that the cam timing could be replaced by other timing devices such as computerized electrical controls.

As the support carriage moves the dancer rollers, controlled by a separate control means, move in tandem with each other along substantially parallel lines back and forth from the edge of the first conveyor belt assembly thereby presenting a gap between the first and second belt assemblies up through which the support carriage may project a folder plate for folding the second tail of the film over the first tail of the film around the napkin product and a sealer bar for sealing the second tail of the film to the first tail of the film. Simultaneously, the support carriage also raises a napkin package back support plate or fingers up through the gap between the parallel belts of the second conveyor belt assembly and in front of the front of the napkin package. By means of a 4-bar linkage and air cylinder mounted to the support carriage and connected to the back support fingers via the slotted block and the sealer bar the back support fingers provide a back support (or could even apply counter pressure if necessary) to the napkin package so that when the sealer bar presses against the napkin package it is not pushed forward and a firm sealing surface is presented against which the sealer bar may press and quickly melt the poly wrap film.

Further, as a means for providing additional support for the napkins as they move through the back seal station a shuttle plate, mounted to side support rails located to either side of the second conveyor belt assembly, is provided.

Accordingly, as the partially wrapped napkins move from the poly wrap feed means they are transferred to the shuttle plate of the second conveyor belt assembly. The first dancer roller and shuttle plate begin to move, maintaining the same speed as before, away from the second conveyor belt. The gap between the two belt assemblies is thus presented. The cam followers riding in the cams and attached to the linkages that connect them to the support carriage then cause the support carriage to rise and follow a predetermined path. As the support carriage rises the folder plate also rises followed by the back or rear sealer bar. The folder plate is actually a grate having openings between which the sealer bar may, after the folder plate has raised and smoothed the second tail of the poly film against the first tail and napkins, press against and seal the back or rear seal of the poly film thus creating the rectangular tube.

Because the ends of the poly tube, that are formed when the bottom folder folds the second tail of poly wrap film over the first tail of poly wrap film, necessarily must extend beyond the sides of the napkins, in order that the ends of the poly film tube may be tucked in and folded down to cover the sides of the napkins, it is desirable to have a seal bar arm back up mechanism so that maximum sealing support along the entire length of the rear or back seal is provided.

The seal bar back up arms are mechanical arms having a proximate end mounted to a pivot axis and a distal end having a backing bar. The seal bar backup arms are actuated via bar cams so that the distal ends are moved about the pivot axis and are swung into the open ends of the poly tube so that the backing bars are positioned to provide a backing against which the sealer bar can press. Therefore, the napkins and the backing bars, acting in combination, provide a substantially contiguous surface against which the sealer bar can press and a rear or back seal can be made that extends substantially the entire length of the poly film tube. Once the seal is made the backing bars pivot back away from and out of the poly film tube.

The napkins contained within the tube are then moved to the side flap tucker station. A tucker makes an end fold on each end of the tube and the napkins now contained in a package then move into a conventional end folding section of the machine which folds the remaining side portions of the film. The package then moves between end sealing belts producing a completely sealed product.

DETAILED DESCRIPTION

Figure 1:
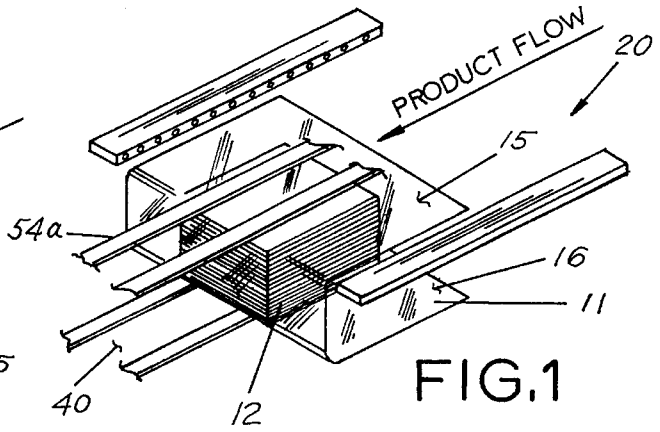
FIG. 1 is a perspective view showing the direction of product flow and the napkins and poly film on the conveyor assembly of the present invention.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention which is defined by the claims.

Referring to FIGS. 1–3, and 11, the present invention is a napkin wrapping machine 10 for wrapping napkins 12. Napkins 12 come in a variety of sizes and shapes and the present machine 10 is designed to be adjustable to handle all standard varieties of sizes and shapes of napkins 12 and to operate in a high efficiency and low waste manner. However, based upon this disclosure it will be apparent that the machine 10 may also be modified to handle any size of napkin 12 that is nonstandard.

The main feature of the machine 10 is the manner and structure that allows the rear or back seal 13 to be made on the poly film 11 that is used to make the napkin packages. See FIGS. 1–3. The other portions of the machine 10 that feed a stack of napkins 12 into the napkin wrapping machine 10, place the initial piece of poly film wrap 11 over the napkins 12 and tuck in the end folds of the poly film 11 on to the sides of the napkins 12 after the rear seal 13 has been made have all previously either been disclosed in the previously noted patents or are known within the industry.

However, the combination of these parts in conjunction with a unique sealing station 20 of the present invention is itself unique. See FIG. 5.

Referring to FIGS. 1 through 4, 11, and 12, it may generally be seen that, once the napkins 12 have been feed into the poly film feeding mechanism 180 from the conveyor mechanism 170, the napkins 12 are conveyed through and out of the seam sealing station 20 by a plurality of conveyor belts 52, 54, and 54*a* that are located below (belts 52 and 54) and above (belt 54*a*) the napkins 12.

The rear seam sealing station 20 of the present invention works as follows: Once the poly film wrapper 11 has been placed in the form of a horizontally disposed U of poly film 11 around the napkins 12, the first tail folder 14 folds down the first tail 15 of the poly film wrap 11. After the first tail folder 14 comes down and folds down the first tail 15 of the poly film wrap 11, the support carriage 30 brings up the second tail folder 22, the rear seam sealer bar 24, and the napkin package support bars 26. The second tail folder 22 folds the second tail up over the first tail 15 and then napkin package support bars 26 and rear seam sealer bar 24, located on opposite sides of the napkins 12 are activated so that when the rear seam sealer bar 24 activates the napkin package support bars 26 are brought into final position against the front side of the napkins 12. See FIGS. 2,3, and 5.

Figure 2:
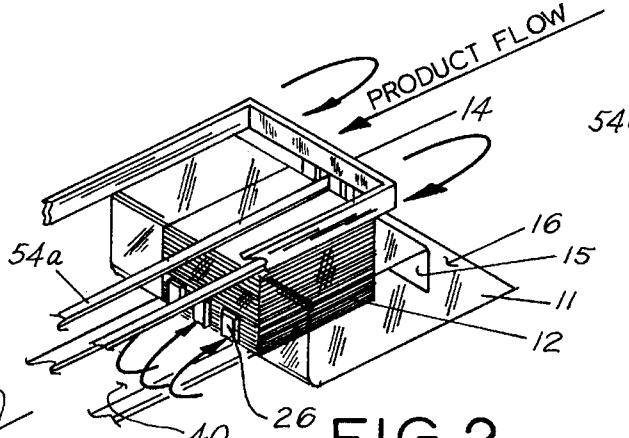
FIG. 2 is a perspective view showing the second tail folder and the napkin package support bars as the product moves on the conveyor assembly through the present invention.
Figure 3:
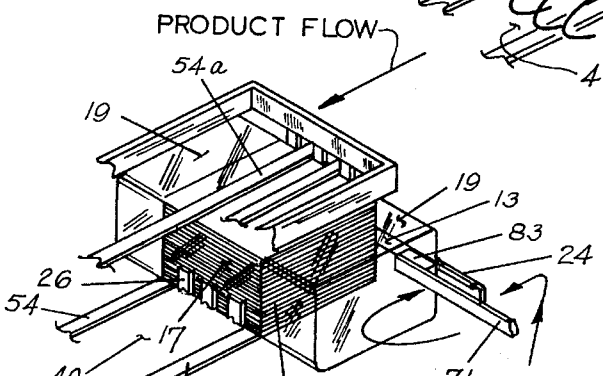
FIG. 3 shows the rear seam back up bar and rear flap sealer bar coming into position and sealing the second tail of film material to the first tail of poly film material to form the rear seam.
Figure 4:
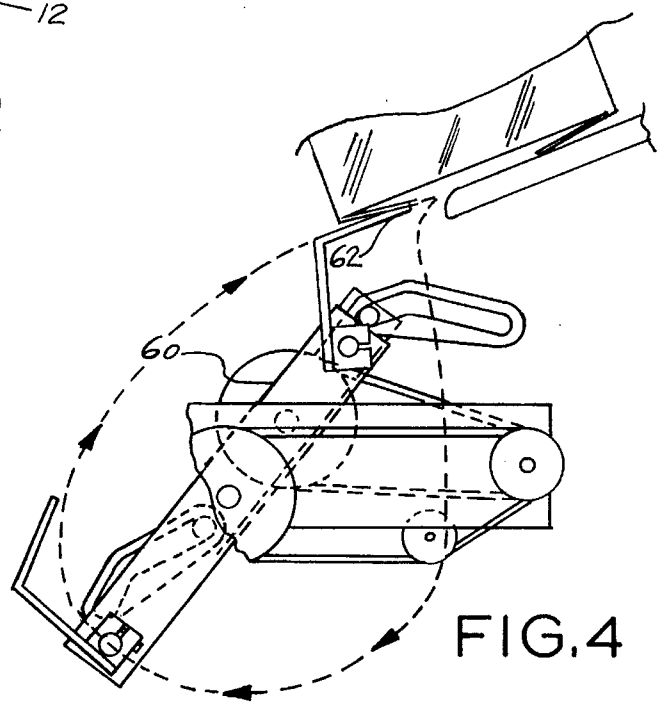
FIG. 4 is a top plan view showing how the ends of the tube of poly film wrapping material are tucked in by the tucker mechanism.
Figure 5:
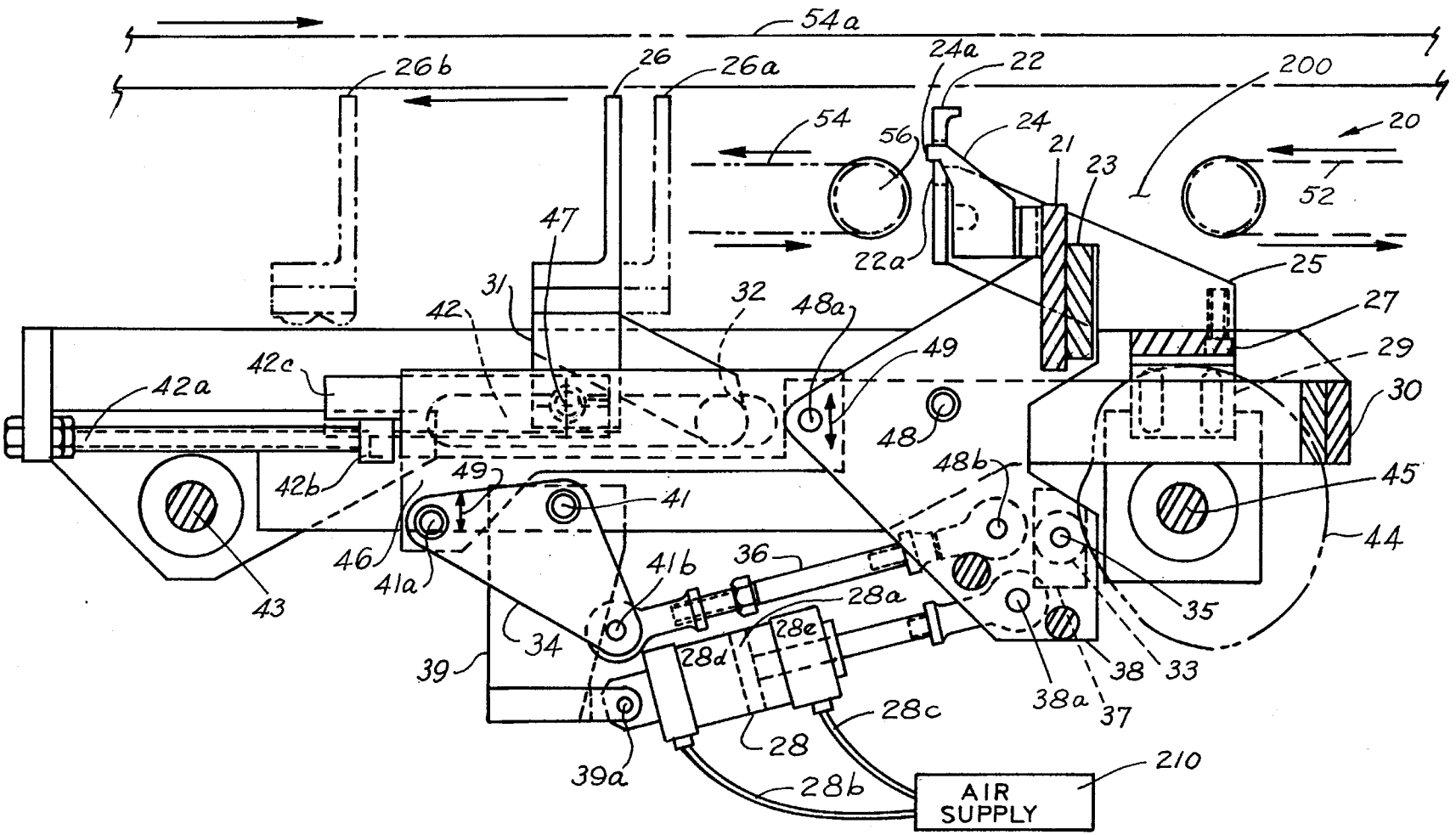
FIG. 5 is a side view of the support carriage assembly.
Figure 7:
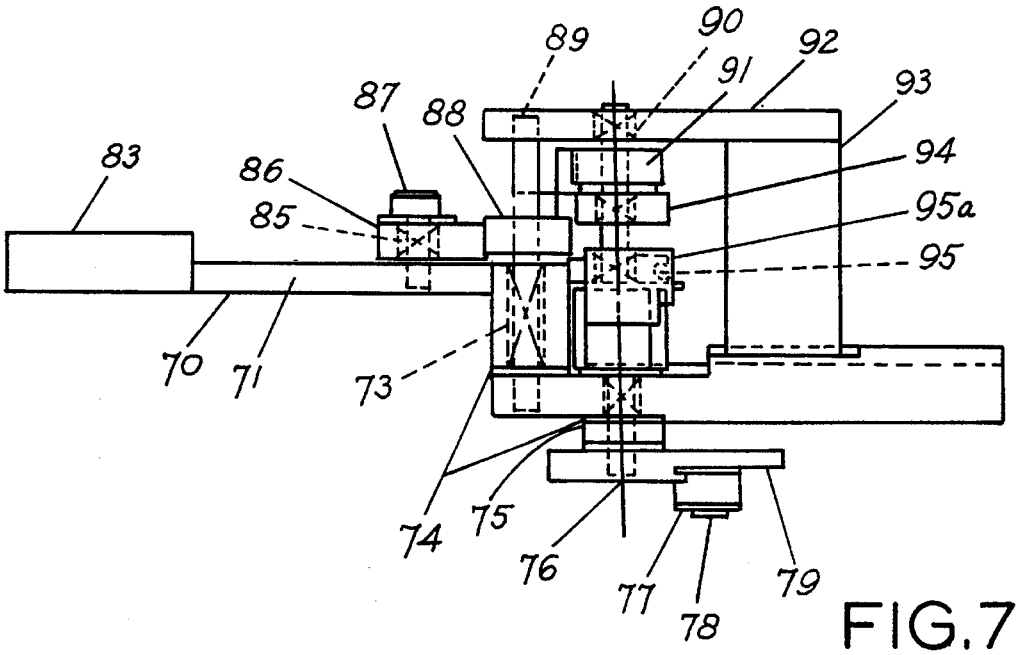
FIG. 7 is a front view of the rear sealer back up bar assembly.

Still referring to FIGS. 2,3, and 5, more specifically immediately after the first tail 15 has been folded down by the first tail folder 14, the second tail folder 22 folds up the second tail 16 of the poly film wrap 11 over the first tail 15 to form the rear seam 13. Accordingly, the rear seam sealer bar 24 and the rear sealer back-up bars 71 are brought into position so that the rear seam sealer bar 24 and the napkin package support bars 26 appear on opposite sides of the napkins 12 so that the napkins 12 are supported relative to the support bars 26 and the entire length of the rear seam 13 against which the rear seam sealer bar 24 is pressed has sufficient support to hold the poly film 11 of the rear seam 13 against the rear sealer bar 24 because the napkins 12 and the rear sealer backup bars 71 of the rear sealer back up bar assembly 70 (See also FIGS. 7–9) present a contiguous surface for the rear seam sealer bar 24 to press against. Thus all the poly film 11 is sealed along the entire length of the rectangular tube 17 of poly wrap film 11 that has been formed. Next the ends 19 of the poly wrap film tube 17 are tucked in by means of the tucker plate 62 of the tucker mechanism 60.

Figure 15:
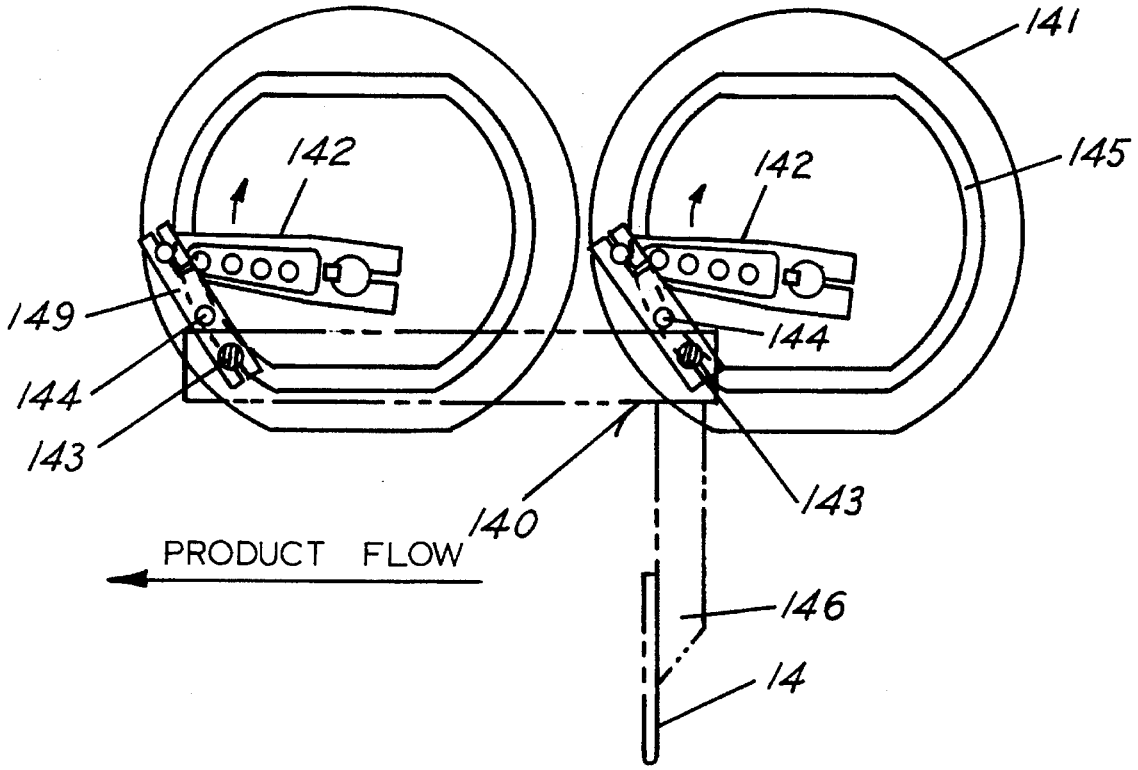
FIG. 15 is an elevational view of the upper carriage of the sealing station showing the cranks and cam tracks that support and guide the movement of the upper carriage and the first tail folder.
Figure 16:
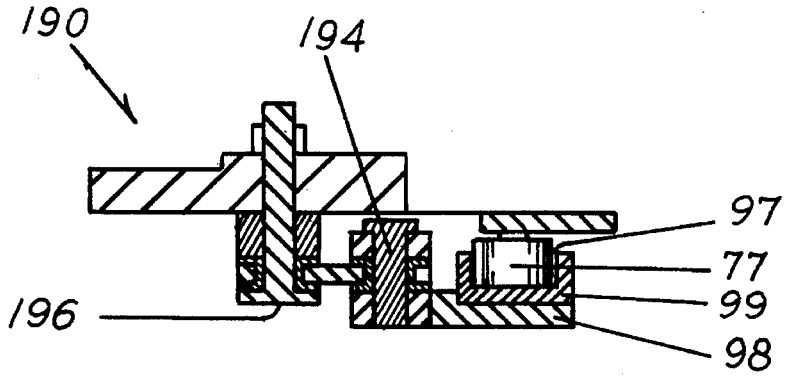
FIG. 16 is a view from line 16—16 of FIG. 8.

Referring to FIG. 15, the device of the first tail folder 14 is similar to the paddles 122 disclosed in U.S. Pat. Nos. 4,624,096 and 4,426,825 except that the first tail folder 14 does not help propel the napkins 11 through the machine 10 and is mounted to an upper carriage 140 that is mounted by a pair of support shafts 143 (shown in cross-section) to the side cams 141. The support shafts 143 are connected to links 149 which are connected to cranks 142. Cam followers 144 ride in cam tracks 145 located in side cams 141 found at each side of the upper carriage 140. The cam followers 144 are mounted into the links 149. The side cams 141 control the motion of the first tail folder 14 so that it coincides with the per cycle movement rate of the napkins 12 through the machine 10 by means of the upper belt assembly 54*a* and the lower belt assembly 50. Note that the side cams 141 are fixed and that the crank and link systems including the carriage 140 rotate as a unit around the fixed side cams 141.

Referring specifically now to FIGS. 5, 10, 13, and 14 it may be seen that the support carriage 30 of the sealing station 20 includes a mounting bracket 31, an adjustment slot 42, a pivot point 47, napkin package support bars 26, a folder plate 22 having openings 22*a* and mounted to the support carriage 30 by a mounting bracket 25, a mounting plate 27, and adjustable mounting plates 29. Further, the rear seam sealer bar 24 has sealing portions 24*a* and is mounted to a bell crank 38 via a mounting bar 21 and a mounting block 23. Also, the sealing station 20, as shown in FIG. 5, includes an edge cam 44 against which a cam follower 33 rides and is held in place by a pin 35 and a spacer 37, bell cranks 34 having pivot points 41, 41*a*, and 41*b*, and bell cranks 38 having pivot points 48, 48*a*, and 48*b*, an air cylinder 28, and a slotted block 46. The carriage 30 is supported by a pair of support shafts 43 and 45 that are connected to bell cranks 100 that are mounted to cam followers 102 that ride in cam tracks 103 located in side cams 104 found at each side of the support carriage 30. Again, cams 104 do not rotate but the respective bell crank and crank systems including the carriage 30 rotate around the fixed cams 104.

It should be noted that the arrangement of the bell cranks 34 and 38 is the same on both sides of the support carriage 30. While only one set of bell cranks 34 and 38 could be used it is not preferred.

The mounting bracket 25, mounting plate 27, and adjustable mounting plates 29 all support the folding plate 22. The rear seam sealer bar 24 is mounted to the bell cranks 38 via mounting bar 21 and mounting block 23.

The entire support carriage 30 moves in the path defined by the side cams 104. (See FIG. 10). Still referring to FIG. 5, the cam follower 33 may be seen to move on the edge cam 44 which rotates on shaft 45. Shaft 45 derives its rotation from the motion of the lower support carriage 30 (FIG. 10) and its related bell crank 100 and crank 100*a*. The adjustment rod 36 is connected so that it extends from bell crank 38 to bell crank 34. Also mounted to the bell crank 38 at pivot point 38*a* is the air cylinder 28. The air cylinder 28 is mounted at pivot point 39*a* to a fixed mounting bracket 39. Accordingly, the air cylinder 28 acts as a spring while the adjustment rod 36 acts as a push rod.

As may be seen in FIG. 5, the air cylinder 28 has a piston 28*a* and is connected to an air supply 210 at air lines 28*b* and 28*c* that allow air to be pumped into or out of the chambers 28*d* and 28*e* that are located to either side of the piston 28*a*. Typically, when the machine 10 is in operation the air pressure in both chambers 28*d* and 28*e* will be set at predetermined levels such that the pressure in chamber 28*d* is greater than the pressure in 28*e*. This causes the air cylinder 28 to act as an adjustable spring since the movement of the piston 28*a*, controlled by the edge cam 44 against which cam follower 33 rides and to which the air cylinder 28 is connected via bell crank 38, is affected by the pressure of the air in each chamber 28*d* and 28*e*. Accordingly, it is preferred that when the machine 10 stops that either the air pressure in chamber 28*d* be reduced or the pressure in chamber 28*e* be increased so that the piston 28*a* compresses or moves toward point 39*a* on mounting 39 and the bell crank 38 is actuated to move the rear seam sealer bar 24 away from the second tail folder 22 thereby ensuring that the hot rear seam sealer bar 24 does not remain in contact with any of the workpieces while the machine 10 is stopped or idle.

As the carriage 30 rides on side cams 104, the napkin package support bars 26 are brought up between the gap 40, located between the belts 54 of the lower belt assembly 50 (See FIG. 3), and the rear seam sealer bar 24 is brought through the gap 200 (See FIGS. 5,6, and 12), when the gap 200 is presented between the two conveyor belt assemblies 52 and 54. On the carriage 30 the cam follower 33, mounted to the bell crank 38, moves on the edge cam 44, the bell crank 38 pivots around its pivot point 48 causing adjustment rod 36, which extends from pivot point 48*b* on bell crank 38 to pivot point 41*b* on bell crank 34, to also move bell crank 34. As is shown in FIG. 5, both bell cranks 34 and 38 are connected to the slotted block 46 at pivot point 41*a* and 48*a*, respectively. Consequently, the movement of bell cranks 34 arid 38 causes the slotted block 46 to move in a substantially straight upward and downward manner as indicated by arrows 49. This results in the napkin package support bars 26 being pivoted about pivot point 47 by means of cam follower 32, located in slot 42, mounted via mounting brackets 31 to support bar 26. At the same time rear seam sealer bar 24, also mounted to bell crank 38 by the mounting bar 21 and mounting block 23, is brought into position as also determined by the cam timing of cam follower 33 riding on the edge cam 44; whereby the sealing portions 24*a* of the rear seam sealer bar 24 pass through the openings 22*a* of the folding plate 22 and the rear seam 13 is sealed.

Still referring to FIG. 5, it may be seen that the position of the napkin package support bars 26 may be adjusted as shown in FIG. 5 by the example of some of the possible positions of the napkin package support bars 26*a* and 26*b*. This is accomplished by providing the slotted block 46 with the adjustment slot 42. The position of the napkin package support bars 26 is adjusted by the use of an adjustment rod 42*a* that is connected to an adjustment block 42*b* that is in turn connected to an adjustment bracket 42*c* that carries pivot 47.

The adjustment rod 42*a* is threaded. The position of the pivot 47 may be adjusted by turning the threaded rod 42*a* to move the adjustment block 42*b* and the adjustment bracket 42*c*, thereby moving the pivot 47 to the position desired. Once the pivot 47 has been moved to its desired position the adjustment rod 42*a* may be tightened so that the adjustment block 42*b* and the adjustment bracket 42*c* hold the napkin package support bars 26 in the position desired for the size of napkins 12 that are being packaged.

Figure 6:
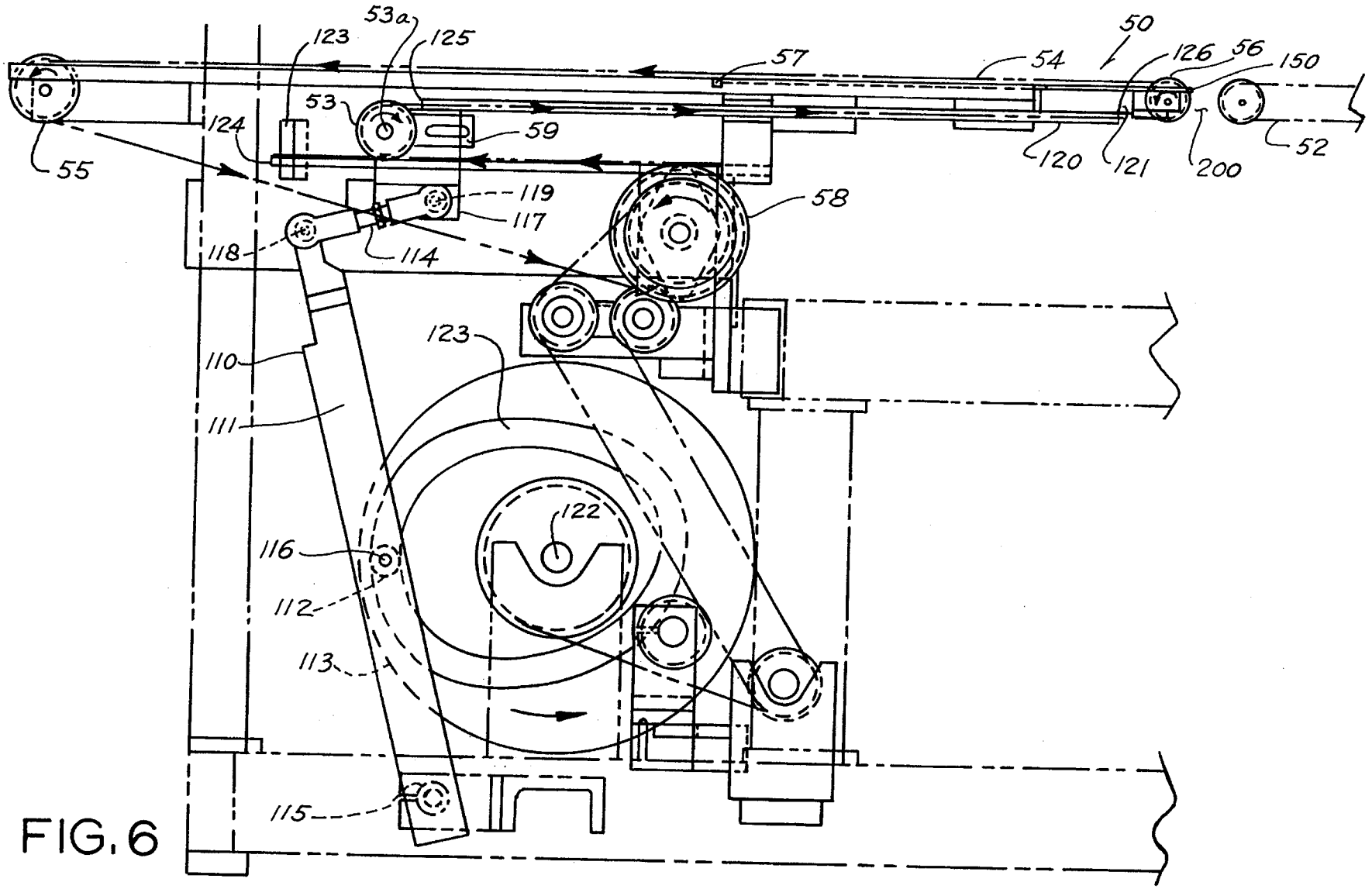
FIG. 6 is a side view of the moveable transport belt assembly.
Figure 11:
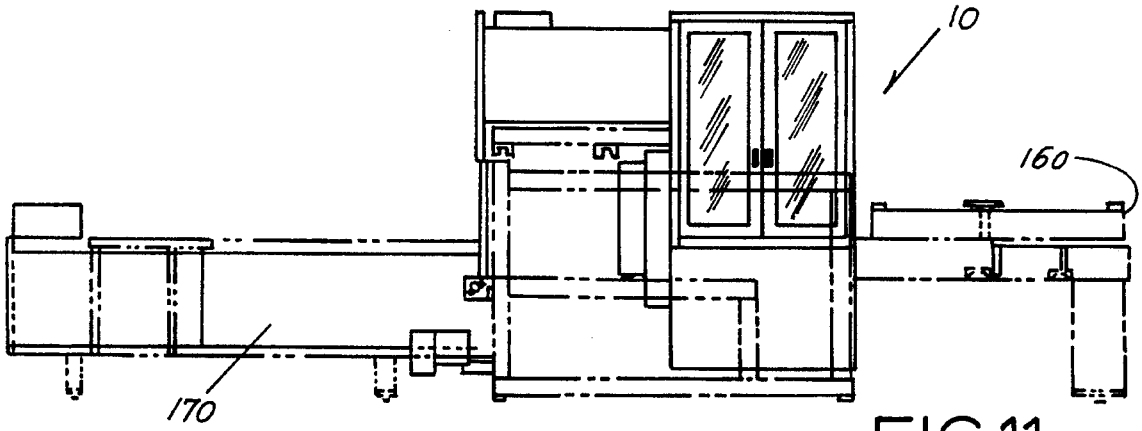
FIG. 11 is a side view of the napkin wrapping machine assembly.

Referring now to FIG. 6, the lower conveyor belt assembly 50 may be seen to comprise a belt assembly 52 and a belt assembly 54. Each belt of the moveable conveyor belt assembly 54 continuously rides over four pulleys 53, 55, 56,and 58. Pulley 55 is a 14 tooth pulley and pulley 58 is a 30 tooth pulley, both of which are fixed in their positions. Pulley 58 is the timing pulley and is the pulley to which power is delivered. Pulleys 53 and 56 are an idler pulley and a 7 tooth pulley respectively. Both pulleys 53 and 56 act as dancer pulleys that move in tandem with each other and parallel to each other in order to present the gap 200.

The conveyor belt assembly 50 further comprises a glide 57 over which the belt 54 and the shuttle plate 150 may move and still have support beneath them so that they are held in proper position.

It is the job of the idler pulley 53 to take up the slack created when the 7 tooth dancer pulley 56 is moved from its position closest to the first belt assembly 52 and to its position farthest away from the first belt assembly 52 so that the gap 200 is presented. See FIGS. 5 and 6. The idler pulley 53 moves parallel to and in tandem with the 7 tooth pulley 56 so that the tension on the belt 54 always remains constant despite the fact that the position of the 7 tooth dancer pulley 56 changes. In this manner the belt 54 may be continuously run and there is no slack or adjustment of tension in the belt 54 while it is continuously running. Therefore, the gap 200 may be presented between the two belts 54 and 52; up through which the folder plate 22 and the sealing bar 24 pass while the napkin package support structure 26 passes up through the gap 40 that is present between the two belts 54 of the second conveyor belt assembly 50.

Still referring to FIG. 6, it may be seen that the dancer pulleys 53 and 56 are actuated and controlled by a timed moving means that is a lever linkage assembly 110 having a bar 111 that has a cam follower 112 mounted to it by cam follower pin 116. The cam follower 112 engages the cam track 123 (shown in phantom) of a box cam 113 so that the bar 111 pivots back and forth on pivot 115 as the box cam 113 is turned on its axis 122. The bar 111 is pivotally connected at point 118 to an adjustable bar 114 that is pivotally connected to a beating block 117 at point 119. The pulley 53 is also connected to the beating block 117 via its shaft 53*a* and idler bracket 59. The bearing block 117 is movably mounted to a hardened shaft 124 so that it can ride back and forth on the hardened shaft 124 as the motion of the cam 113 causes the lever linkage assembly 110 to move the pulley 53.

Still referring to FIG. 6, as previously noted, both pulleys 53 and 56 move in tandem. In the present invention this is accomplished by connecting the two pulleys 53 and 56. Pulley 53 is connected to an idler bracket 59 and pulley 56 is connected to a bar 121. (Also, see FIG. 9). A bar 120, having ends 125 and 126, is mounted so that end 125 is connected to bearing block 117 and end 126 is connected to bar 121. Accordingly, as the lever linkage assembly 110 moves pulley 53, pulley 56 moves in tandem with pulley 53 because the two pulleys are connected by the bar 120.

Referring now to FIGS. 7–9*a*, and 16, the structure of the rear seal back up bar assembly 70 and actuation assembly 190 may be seen. The rear seal back up bar assemblies 70 include a back up arm 71, a seal pad 83 that is mounted to arm 71 which is connected to a support arm link 86 via a shoulder screw 87, a clamp collar 88, a mounting shaft 89, a sleeve bearing 90, a clamp collar 91, a support bar 92, a spacer 93, a pivot link 94, a spring rod 95 integrally connected to a collar 95*a*, a sleeve bearing 73, a thrust washer 74, a sleeve bearing 75, a pivot pin 76, a cam follower 77, a pivot pin 78, a cam lever 79, and an adjusting block 81.

The actuation assembly 190 includes a cam follower 77*a*, actuation bars 191 and 192 having pivots 193–198, a mounting bar 98 having ears 98*a* and 98*b*, and a slotted bar 99 having a slot 97 in which the cam follower 77 is contained. The mounting bar 98 is connected to the slotted bar 99 and is also connected to the pivots 197 and 198 at the ears 98*a* and 98*b* respectively. Accordingly, the actuation assembly is connected to the rear sealer back up bar assembly 70.

While simpler rear sealer back up bar assemblies may be used the present assembly 70 is illustrated because it is a compound lever assembly that may be used for essentially all standard sizes of napkins. However, simpler assemblies dedicated for use in conjunction with just one type of napkin or a more limited range of napkins may also be used.

Further, as a means for providing additional stability and guidance to the shuttle plate 150, the shuttle plate 150 is integrally connected to a bar 121 which is connected to a Thomson linear ball bushing bracket 159 that rides on hardened shaft 151, located to the side of the second conveyor belt assembly 54. Accordingly, both the shuttle plate 150 and the bar 121 move with each other.

Therefore, when the napkins 11 are transferred to the shuttle plate 150 of the second conveyor belt assembly 54 from the first conveyor belt 52. The dancer roller 56 and shuttle plate 150 begin to move, maintaining the constant speed of the napkins 11 as they travel through the machine 10, away from the first conveyor belt 52. The gap 200 between the two belt assemblies 52 and 54 is thus presented.

Figure 8:
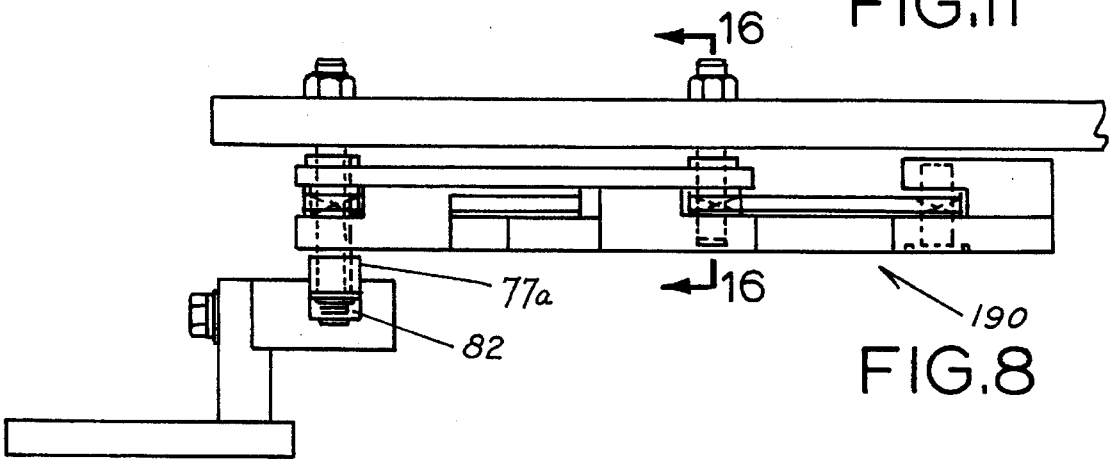
FIG. 8 is a side view of the actuating assembly for actuating the rear sealer back up bar.
Figure 9:
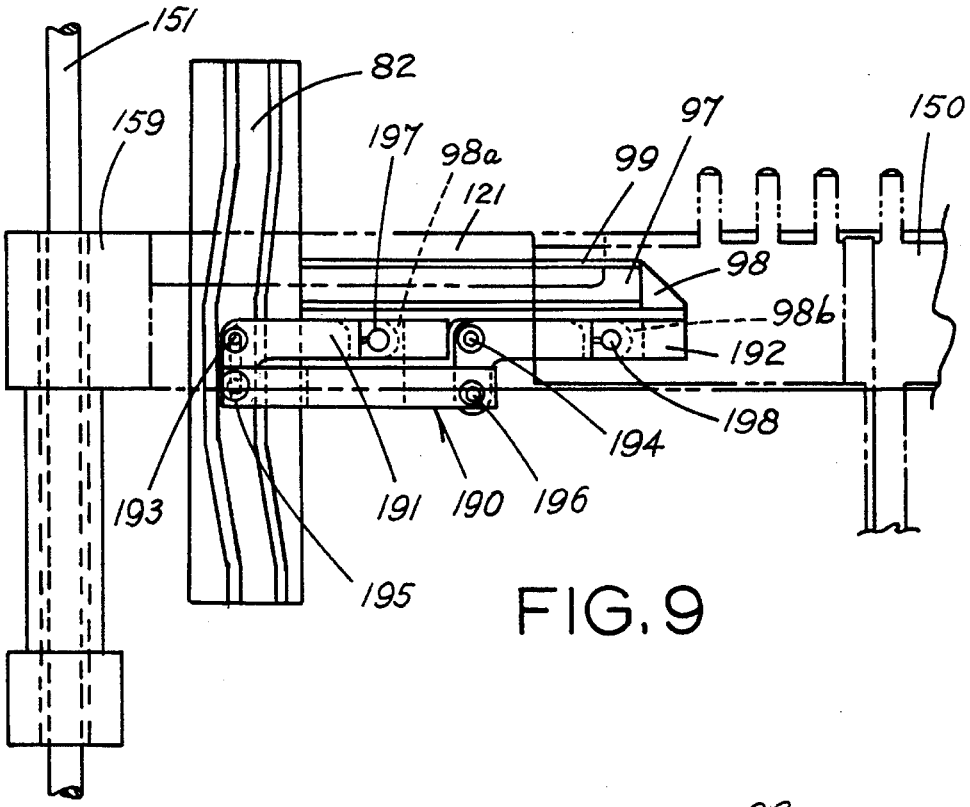
FIG. 9 is a top plan view of the actuating assembly for actuating the rear sealer back up bar and the side support rail and the shuttle plate.
Figure 10:
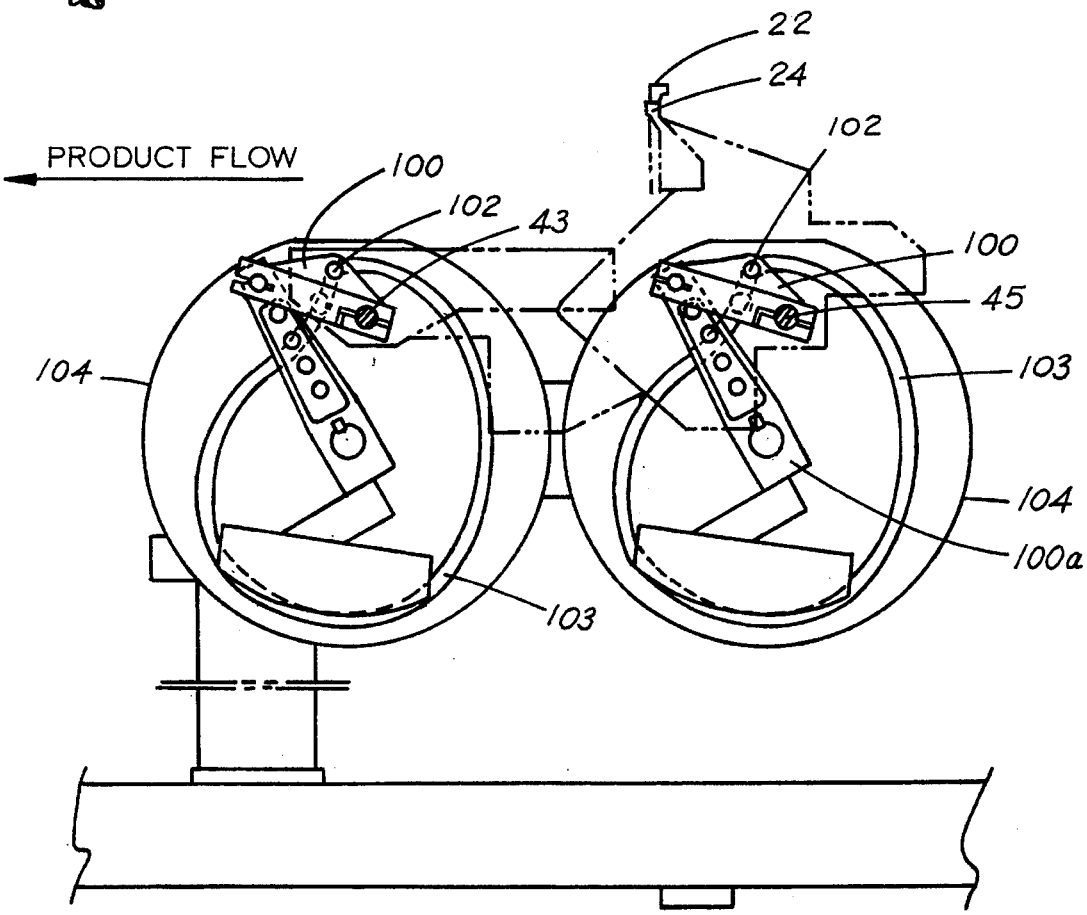
FIG. 10 is an elevational view of the bell cranks and cam tracks that support and guide the movement of the support carriage with the second tail folder and the rear seam sealer back up bar super-imposed.
Figure 9A:
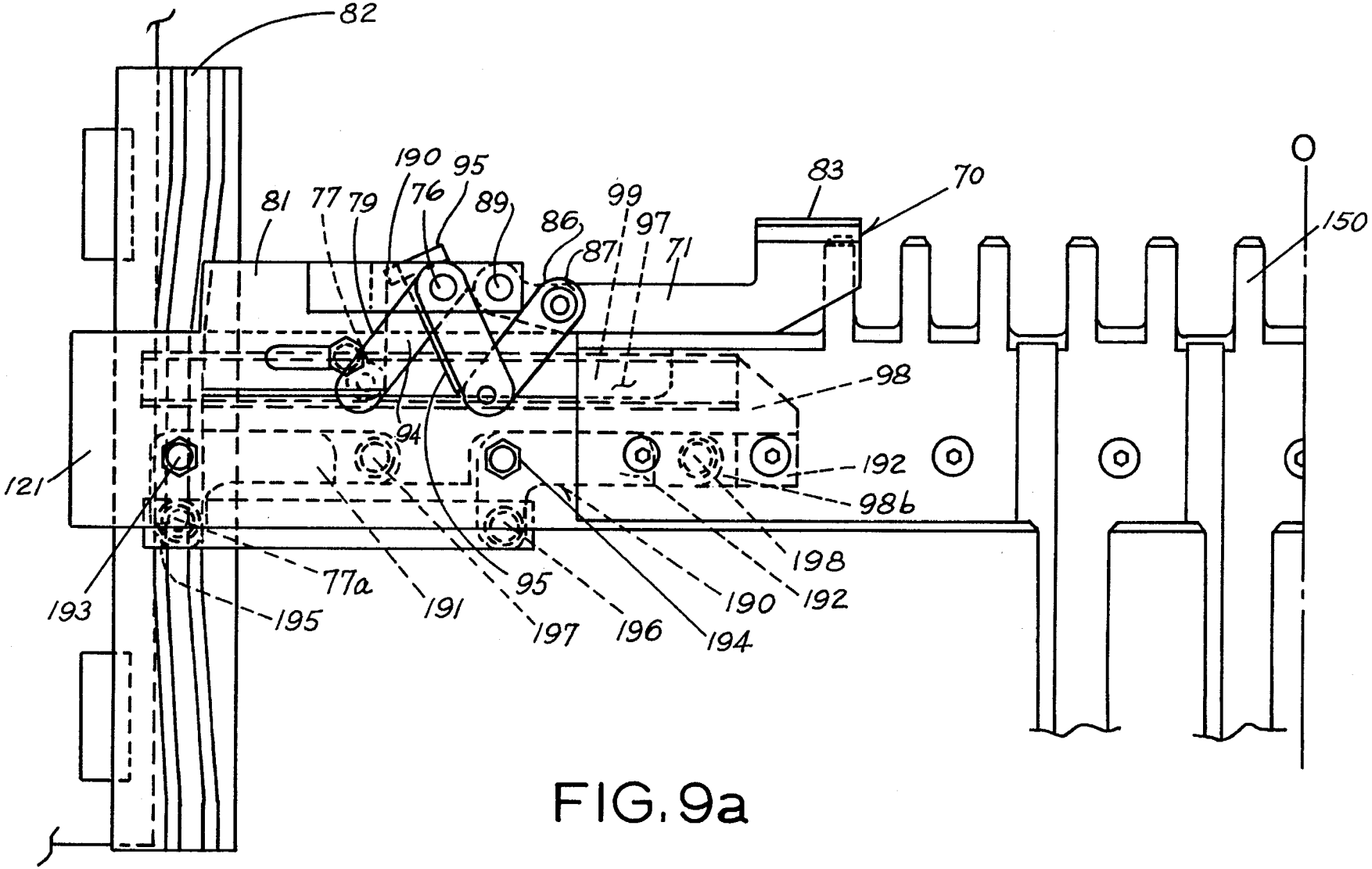
FIG. 9*a* is a top plan view of the actating assembly, the rear sealer back up bar assembly and the shuttle plate.
Figure 12:
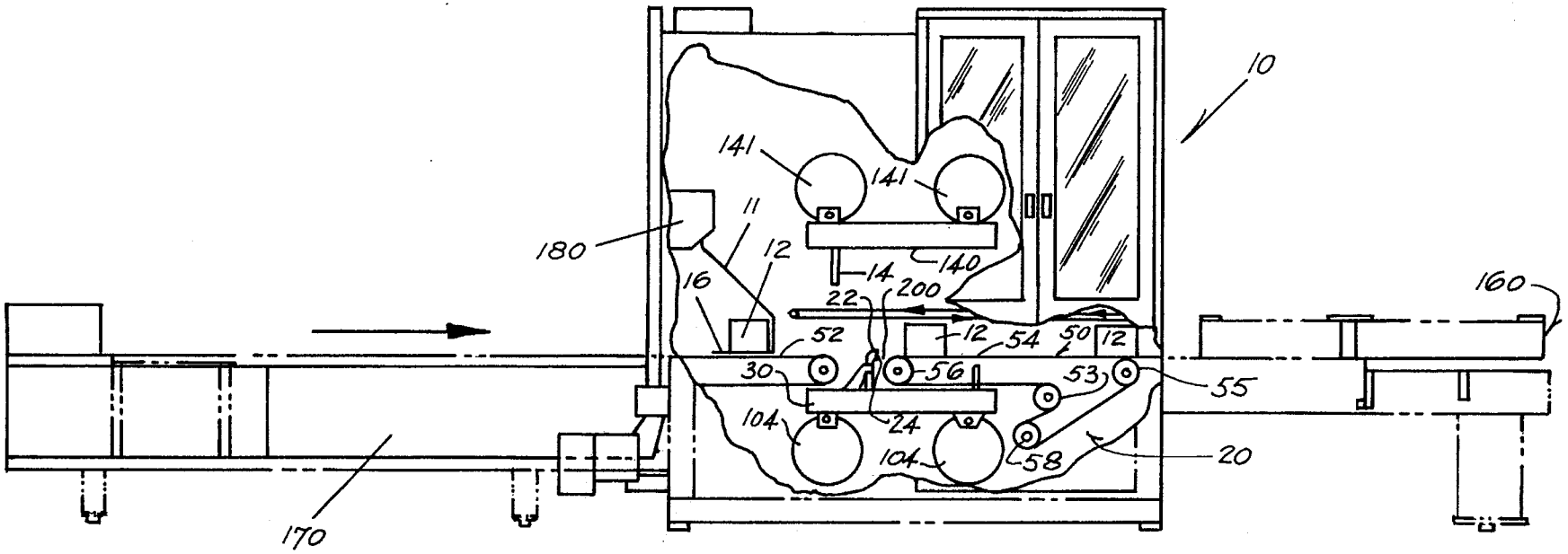
FIG. 12 is a side view of the napkin wrapping machine assembly with a cutaway view showing the general relationship of the components of the assembly.
Figure 13:
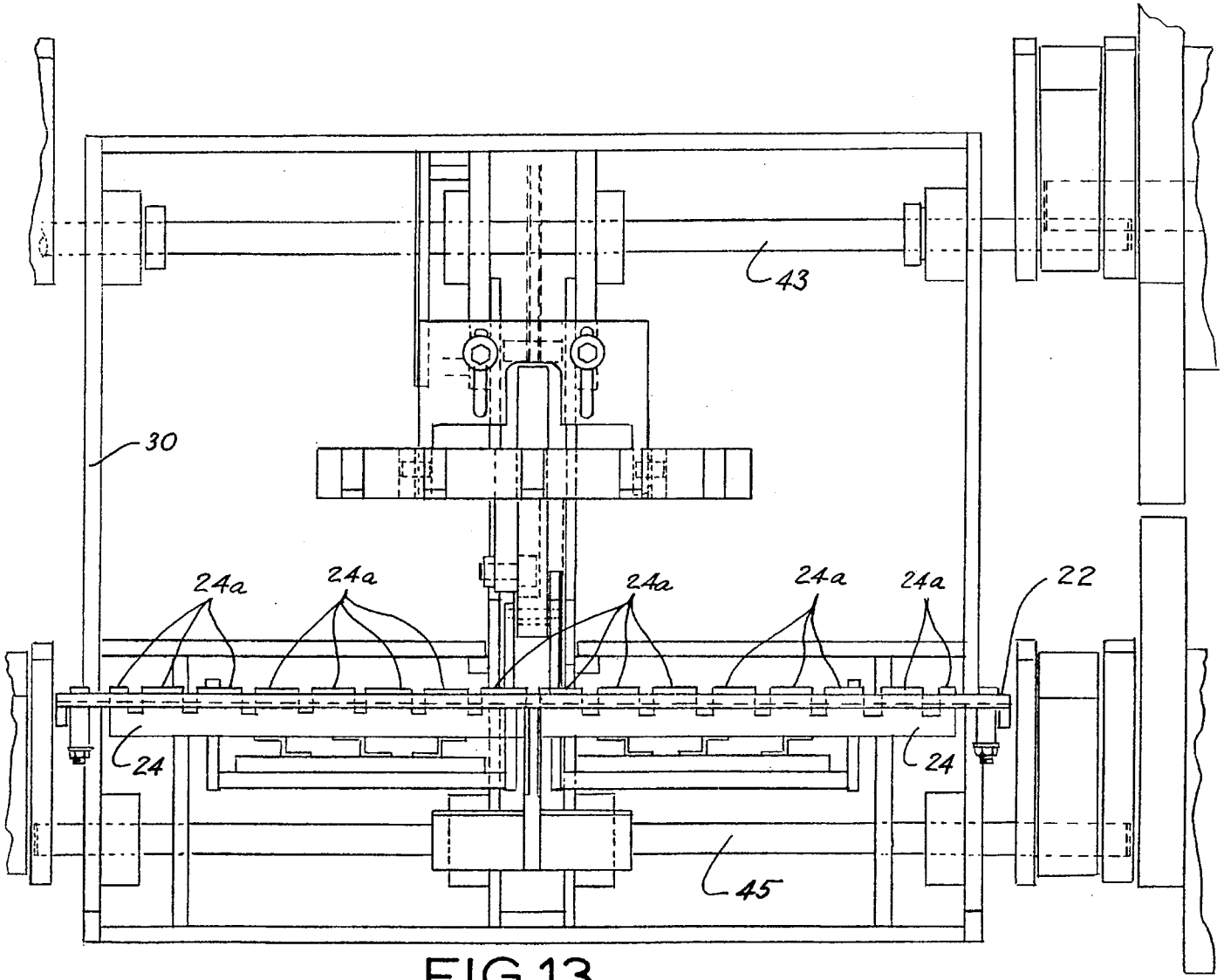
FIG. 13 is a top plan view showing the relationship of the rear seam sealer bar, the second tail folder mechanism, the napkin package support bars, and the side cams of the support carriage.
Figure 14:
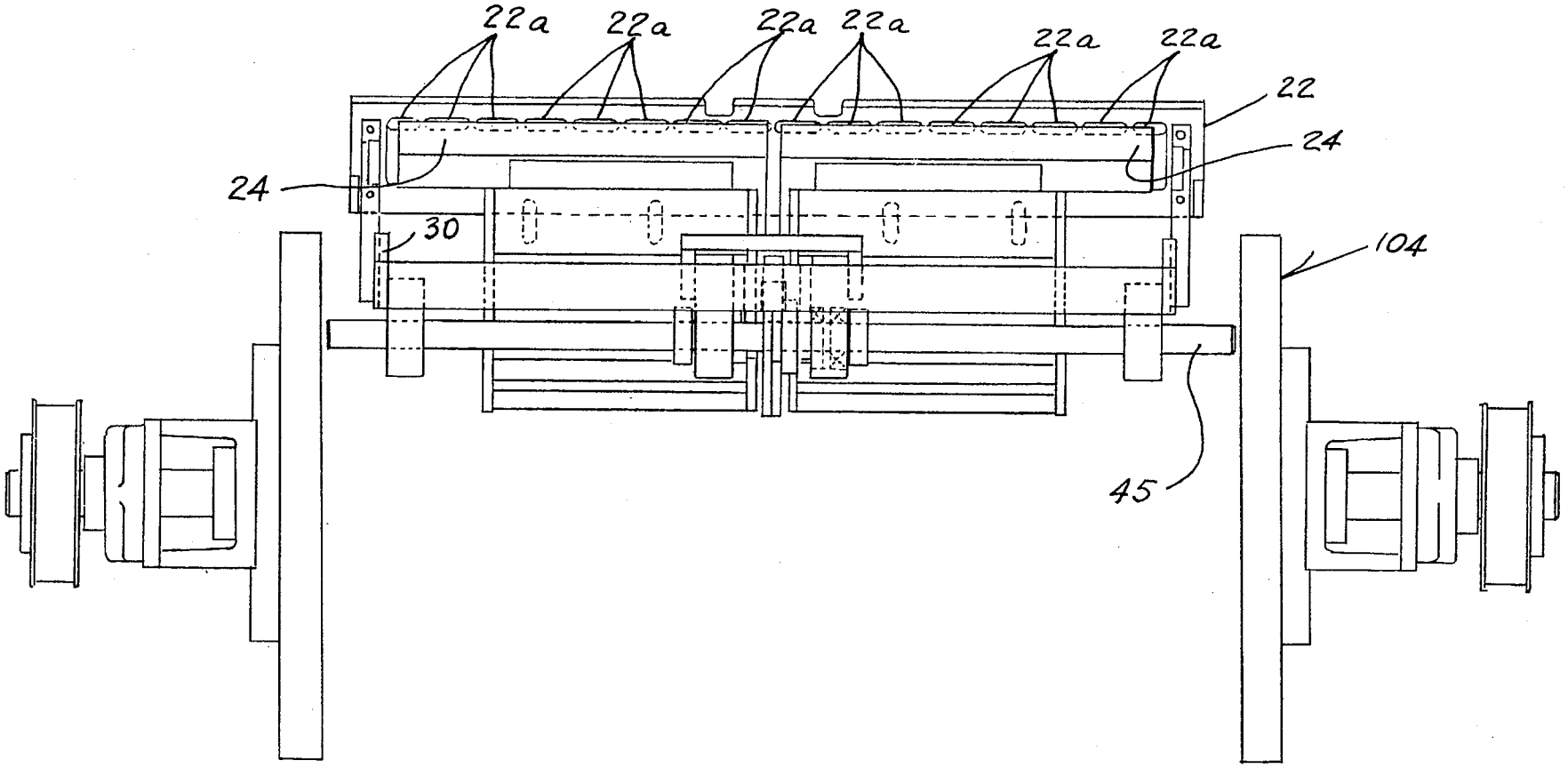
FIG. 14 is a rear elevational view showing the rear seam sealer bar and the second tail folder mechanism.

The actuation assembly 190 and the rear seal back up bar assembly 70 are mounted to the bar 121 as is apparent from FIGS. 8–9*a*, and 16. Accordingly, when the bar 121 moves with the shuttle plate 150 the bars 71 are actuated by the cam followers 77*a* of the actuation assembly 190 that is shown in FIG. 8, 9, and 9*a*. The cam followers 77*a* ride in the cam tracks 82. The movement of the cam followers 77*a* in the cam track 82 causes the bars 191 and 192 of the actuation assembly 190 to pivot at their pivots 193–198. Thus, pivots 197 and 198, connected to the ears 98*a* and 98*b*, push the mounting bar 98 and the slotted bar 99 having the slot 97 in which the cam follower 77 is located. This causes linkage of the assembly 70 to swing the rear seal back up bars 71 so that the seal pad 83 is brought into position (as shown in FIG. 3) just before the folder plate 22 and the rear sealer bar 24 press against the second tail 16 of the poly film wrap 11 in order to present a substantially solid and contiguous surface against which the rear seam sealer bar 24 is then pressed and the rear seal 13 is made.

After the rectangular tube 17 of poly film 11 is formed about the napkin product the tucker arms 60 and the tucker plates 62, using the folder or tucker apparatus disclosed in U.S. Pat. Nos. 4,624,096 and 4,426,825, fold in the ends of the poly film tube and the napkin package is moved to the standard sealing structure 160 wherein the end seals are made.

Despite all the movements and motions of the machine 10 the relative motion of each operation is static in that the napkin package, even though it is moving 27 inches per cycle, is having the folding functions required for creating the rear or back seal done to it by the seam sealing station 20 such that the relative motion would be the same as if the package were stationary. Consequently a high level of control over that part of the process is possible and thus very little scrap is produced.

Figure 19:
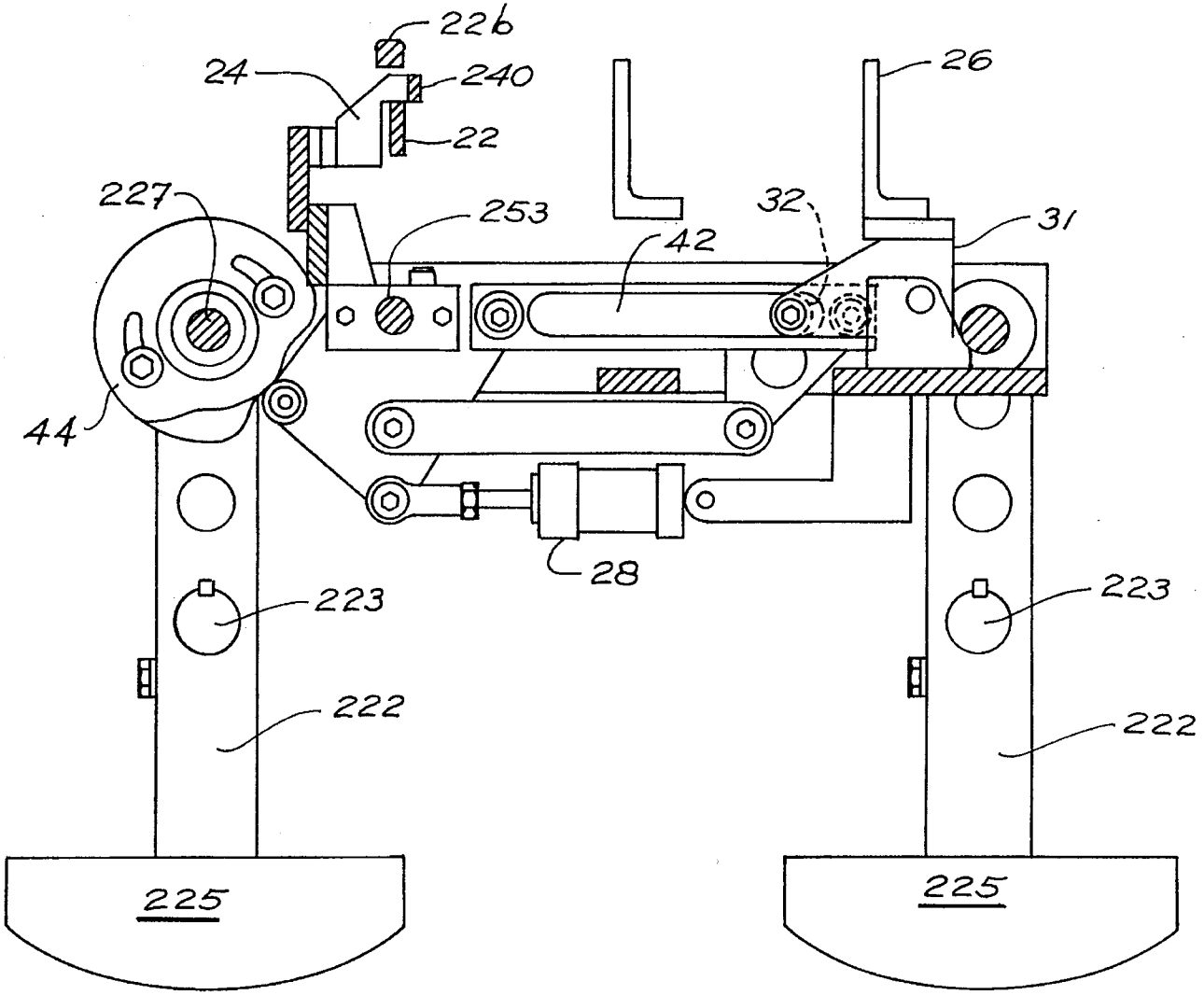
FIG. 19 is a partially cutaway side elevational view, from line 19—19 of FIG. 20, of the lower support carriage to which the bottom or second tail folder and the rear seam sealer are mounted for an alternative embodiment of the present invention.

Alternatively, the machine 10 of the present invention could be modified so that the back or rear seam sealer bar 24 is continuous rather than segmented and covered with a teflon or other nonstick cloth material 240 to minimize any potential adhesion of the poly film to the sealer bar 24. Additionally, the lower flap or second tail folder 22 could be modified to allow the continuous rear seam sealer bar 24 to extend through an opening 220 of it when making a seal. Further, the structure of the upper carriage 140, having the upper flap folder mechanism or first tail folder 14, may be greatly simplified but still retain its original motion by eliminating two of the stationary side cams 141 and the upper carriage system 140 so that only two stationary cams 141 are required. Further, an air bar 250 may be added to the upper flap folder or first tail folder 14 to assist in folding the top flap or first tail 15 of the poly film wrapper 11. Also, on the lower support carriage 30, the system of cranks 100*a* and pivot links 100 may be greatly simplified by removal of the four stationary side cams 104 that previously controlled the motion of the lower flap folder 22 and replacing these timing and movement controls with a vari-drive 230 which along with the four lower cranks 222 produces a motion that matches that of the upper first tail folder 14 to attain the proper folding of the poly film 11 on the napkins 12 for sealing the rear seam 13. Additionally, redesign of the lower flap folder carriage 30 yields a substantial weight reduction and adds simplicity to the design. A comparison of FIG. 5 and FIG. 19 makes apparent these modifications. Further, an edge cam 254, fixed to rotating shaft 227, has been added to tilt the upper tip 22*b* of the lower flap (second tail) folder 22 back and allow clearance as the flap folder 22 goes beneath the transport belt bed plate. Finally, the film back-up arm or rear sealer back up bar assemblies 70 may be redesigned for simplicity and weight reduction by eliminating the four bar linkage systems.

Please refer to FIGS. 17–27 for the details of these various alternative structures for use in the present invention.

Figure 17:
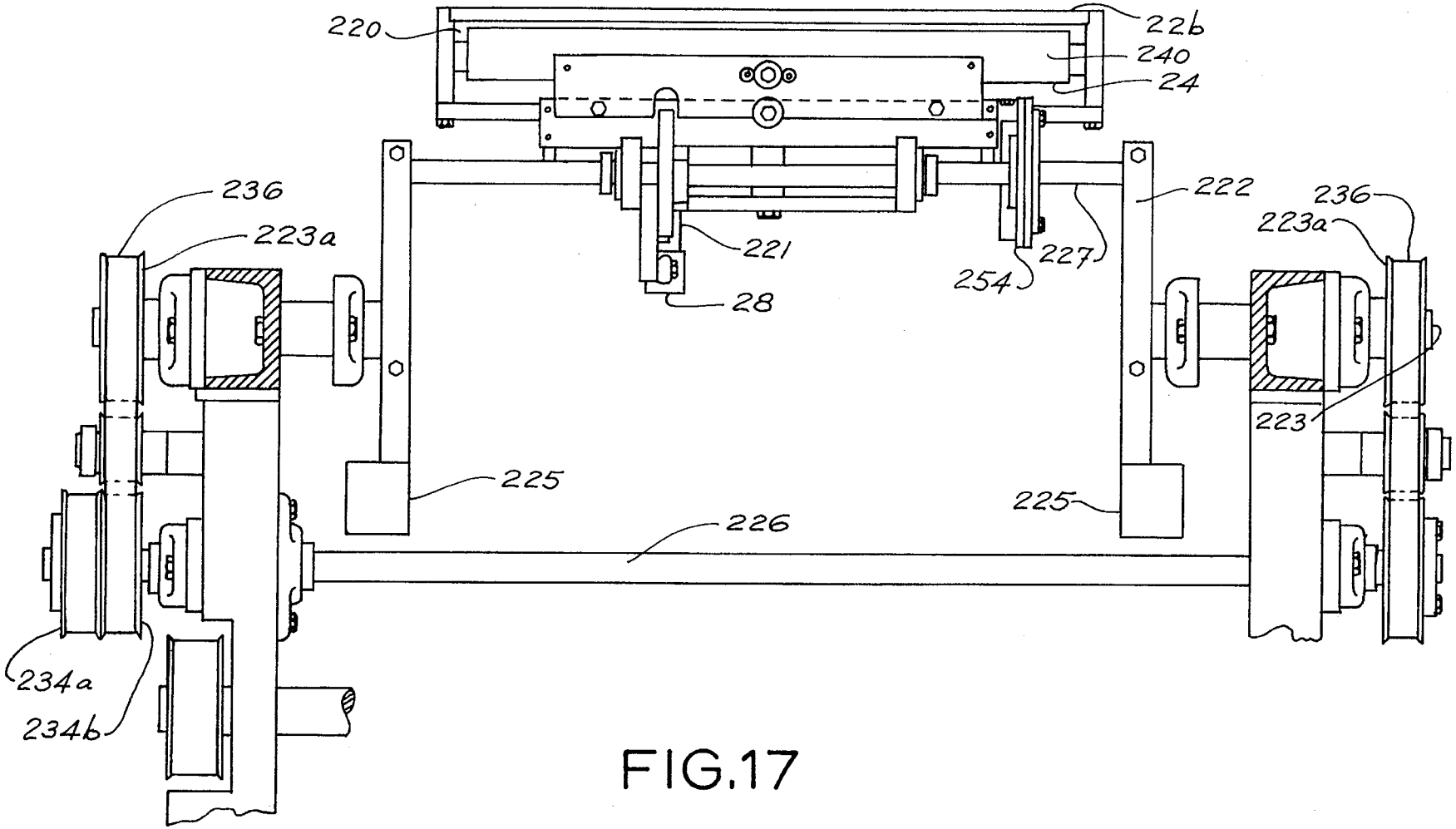
FIG. 17 is a rear elevational view of the rear seam sealer mechanism for an alternative embodiment of the present invention.
Figure 20:
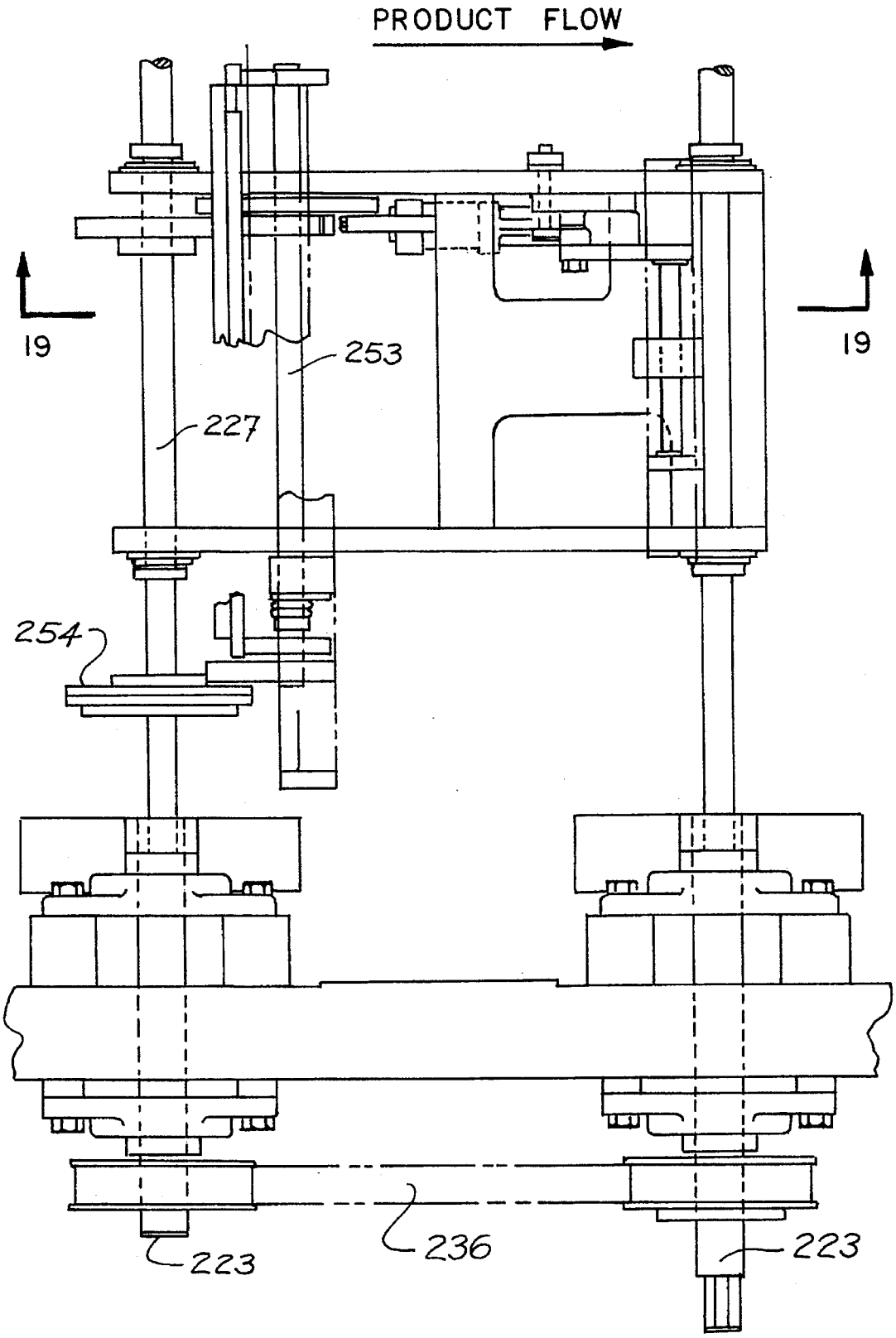
FIG. 20 is a top plan view of the lower support carriage for an alternative embodiment of the present invention.
Figure 20A:
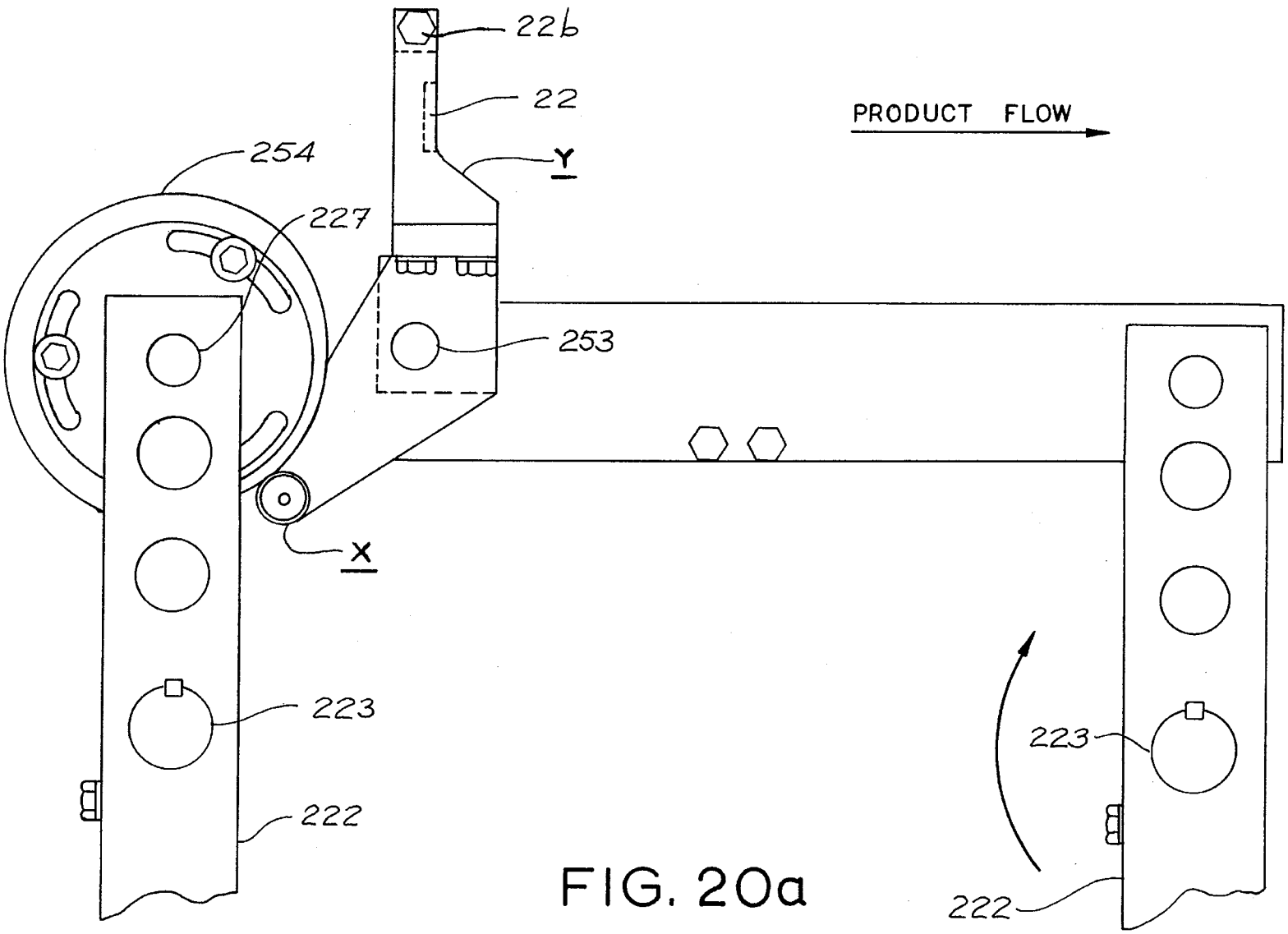
FIG. 20*a* is a side elevational view of the lower flap folder retract mechanism.

Referring to FIGS. 17, 19, 20, and 20*a* the lower flap folder or second tail folder mechanism 22 may be modified so that the heater bar 24 is wrapped or coated with a nonstick cloth material like TEFLON® or a material having nonstick qualities similar to TEFLON brand nonstick material. The mechanism of the lower flap folder 22 may be further modified by the inclusion of a rear flap folder cam 254 for tipping back the tip 22*b* of the flap folder 22 after the fold and seal are made. As is shown in FIG. 20*a*, the lower flap folder 22 tilting mechanism may be seen as upper tip 22*b* and second tail folder 22 which are fastened to pivot shaft 253 by means of a bracket Y which is activated by a cam follower X. Tilting motion is transferred from tilt cam 254 which is fixed to shaft 227. Also, shaft 227 is fixed onto crank arm 222. Cam motion is obtained by the rotation of crank arm 222. Referring to FIG. 17 the alternate structure of the mechanism of the second tail folder 22 may be seen to further include crank arms 222, crank arm shafts 223, carriage drive belt 236, counter weights 225, cross-shaft 226, and carriage shaft 227. Additionally, it may be seen that the openings 22*a* through which the segments of the heater bar 24 previously projected have been replaced by the single opening 220 through which substantially the entire length of the heater bar 24 may be projected to produce the rear seam 13.

Figure 18:
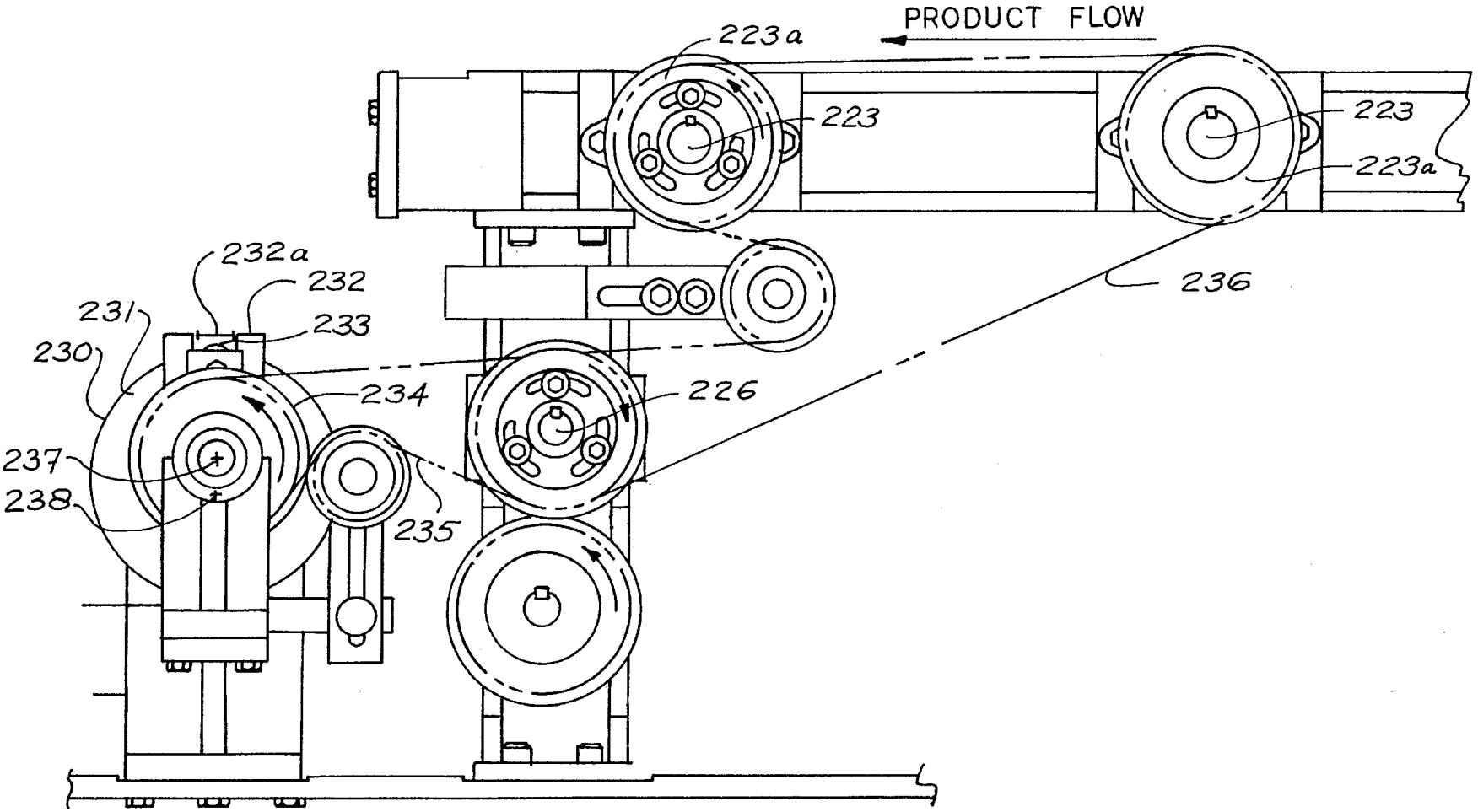
FIG. 18 is a side elevational view of the vari-drive mechanism used to move the lower support carriage to which the bottom or second tail folder and the rear seam sealer are mounted for an alternative embodiment of the present invention.
Figure 27:
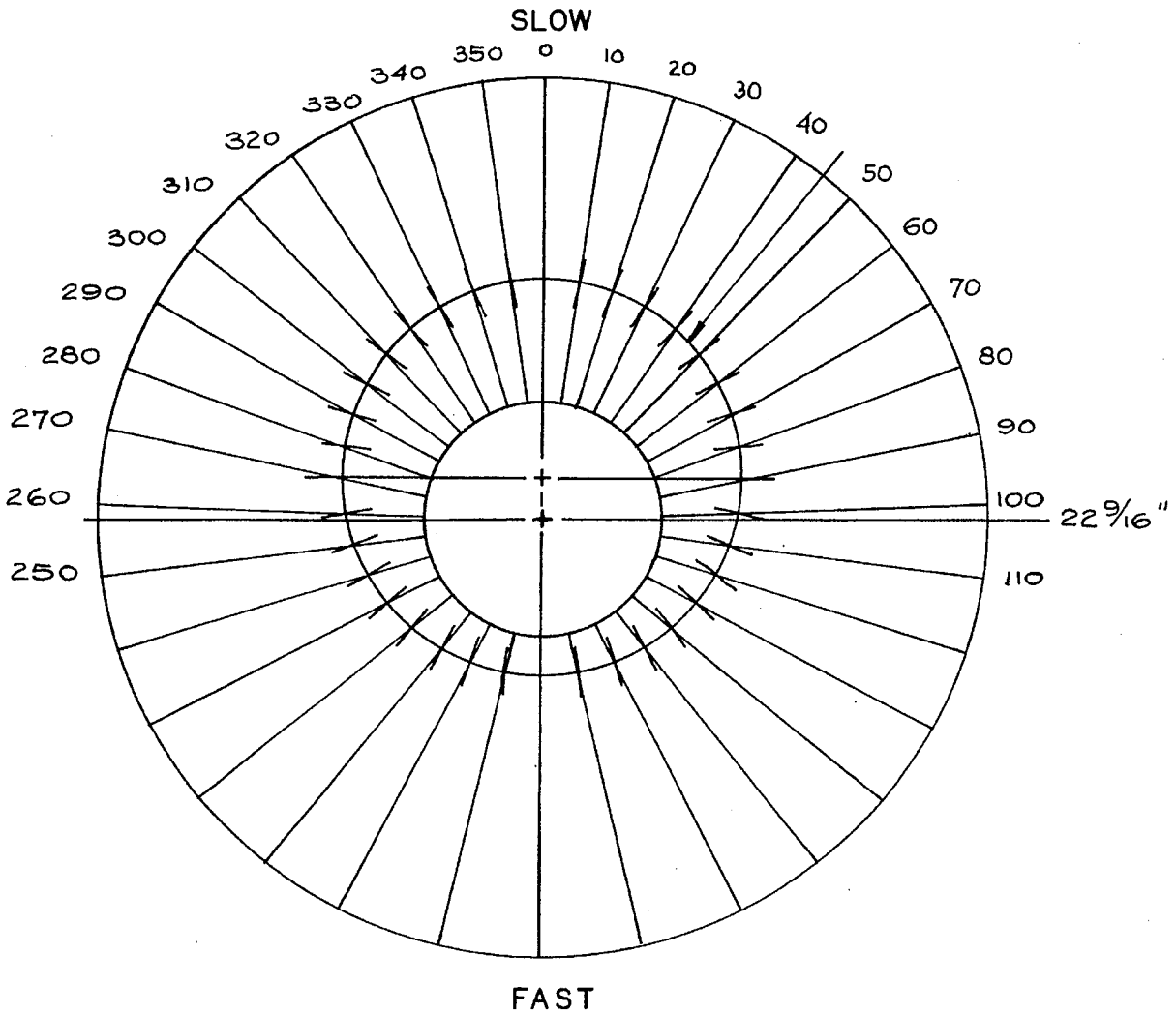
FIG. 27 is a schematic expression of the motion of the varidrive imparted to the crank arms, in a given cycle of movement, showing the distance and movement of the crank arms for every 10° of travel.

Referring to FIG. 18 the vari-drive 230 may be seen to comprise a hub 231 to which is mounted a bar cam 232 having a channel 232*a*. In the channel 232*a* is a cam follower 233 which is bolted or otherwise fastened to a driven pulley 234. Both the hub 231 and the driven pulley 234 have center shafts 237 and 238 to whose ends they are mounted so that shaft 237 is not in alignment with shaft 238. Consequently, as hub 231 turns, bar cam 232 pushes against the fixed cam follower 233 so that, relative to the bar cam 232, the cam follower 233 moves in the channel 232*a* and its position relative to the center shaft 238 of the hub 231 changes. This results in the speed at which the driven pulley 234 is rotated varying as shown in FIG. 27. This varying speed is imparted from the driven pulley 234 to pulley 234*a* by means of belt 235 mounted on cross shaft 226 and then by the drive belt 236 and pulley 234*b* to the pulleys 223*a* to which the crank arm drive shafts 223 are fixed. This results in the shafts 223, connected to the crank arms 222, being driven by the vari-drive 230 and thereby actuating the crank arms 222 and the entire mechanism of the lower flap folder 22.

Figure 21:
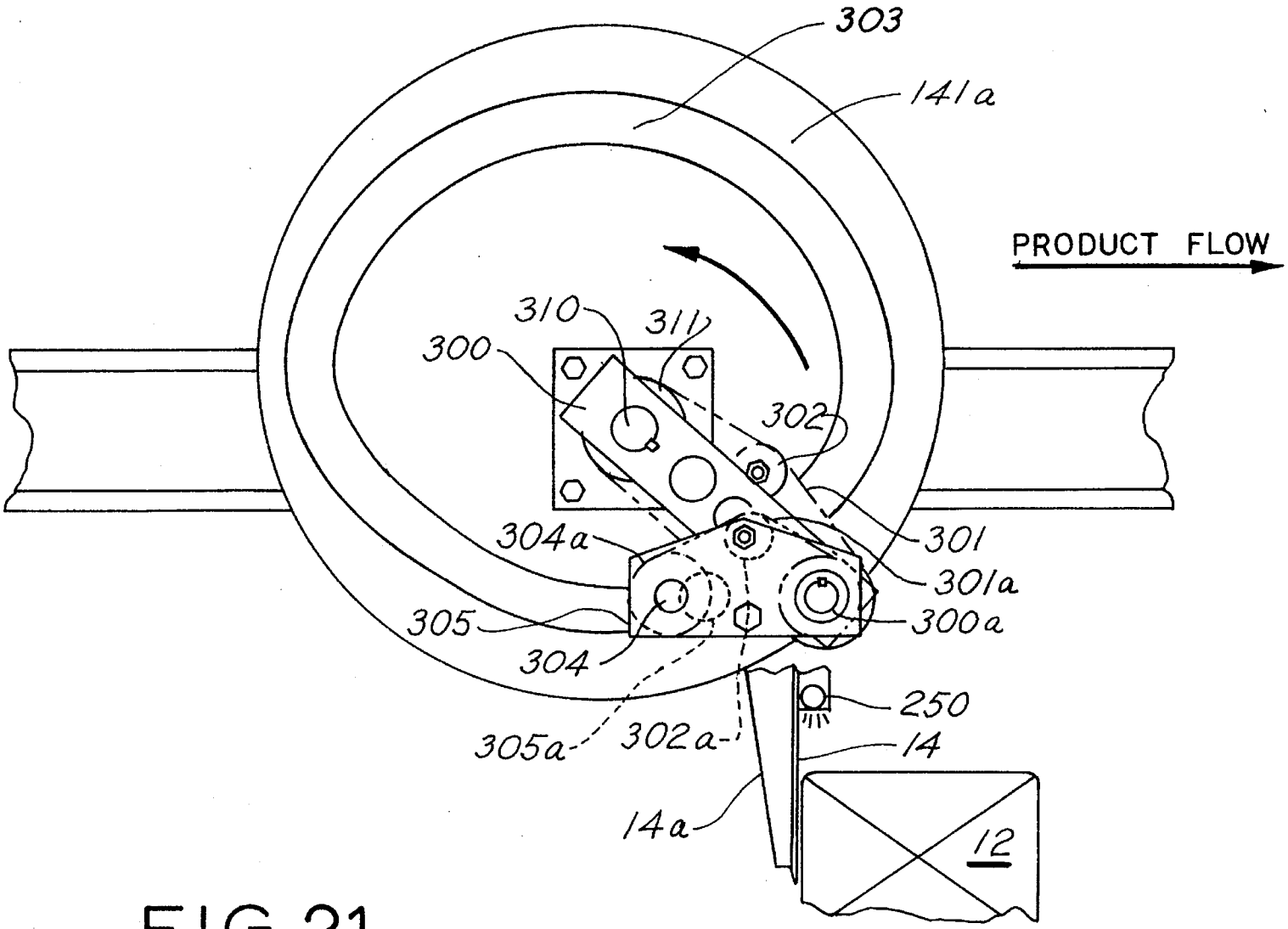
FIG. 21 is a side elevation view of one of the upper cams for controlling the movement of the first tail folder for an alternative embodiment of the present invention.
Figure 22:
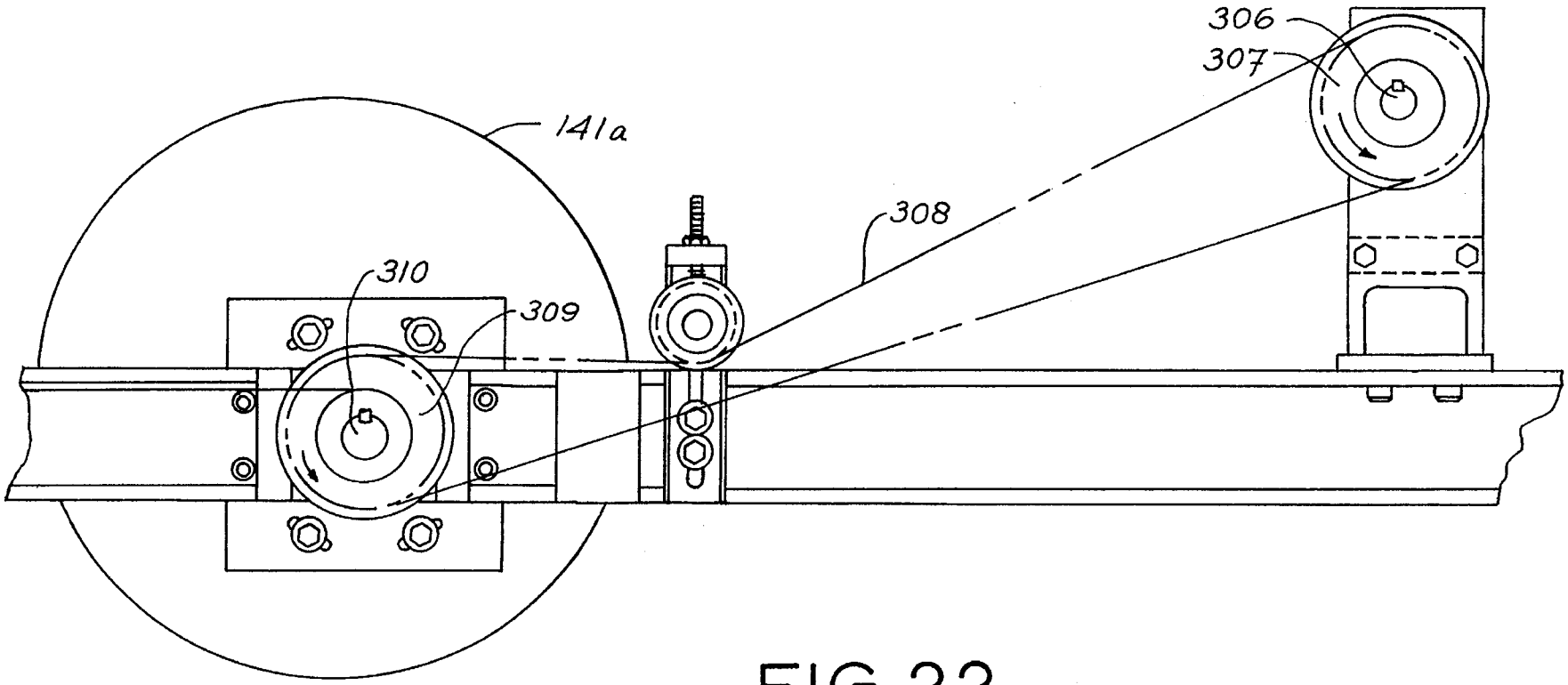
FIG. 22 is an external elevational plan view of a portion of the drive mechanism for the first tail folder assembly for an alternative embodiment of the present invention.

Referring now to FIGS. 21–24 an alternative modified structure for the upper carriage assembly 140 may be seen. First, as previously noted this modification allows for two of the side cams 141 to be eliminated. Consequently, the drawings refer to only two side cams shown as 141*a*. Referring to FIG. 22 an external or outside view of the side cam 141*a* may be seen. In FIG. 22 crank arm drive shaft 310 is seen connected to a pulley 309 driven by a belt 308. The belt 308 is driven by pulley 307 which is mounted to a shaft 306. The shaft 306 extends above and across the structure of the upper carriage assembly 140 to an identical pulley and belt system on the other side of the upper carriage assembly 140, see FIG. 21. This system drives the shaft 310 which drives the crank arms 300 around the two side cams 141 located on each side of the assembly 140.

Figure 23:
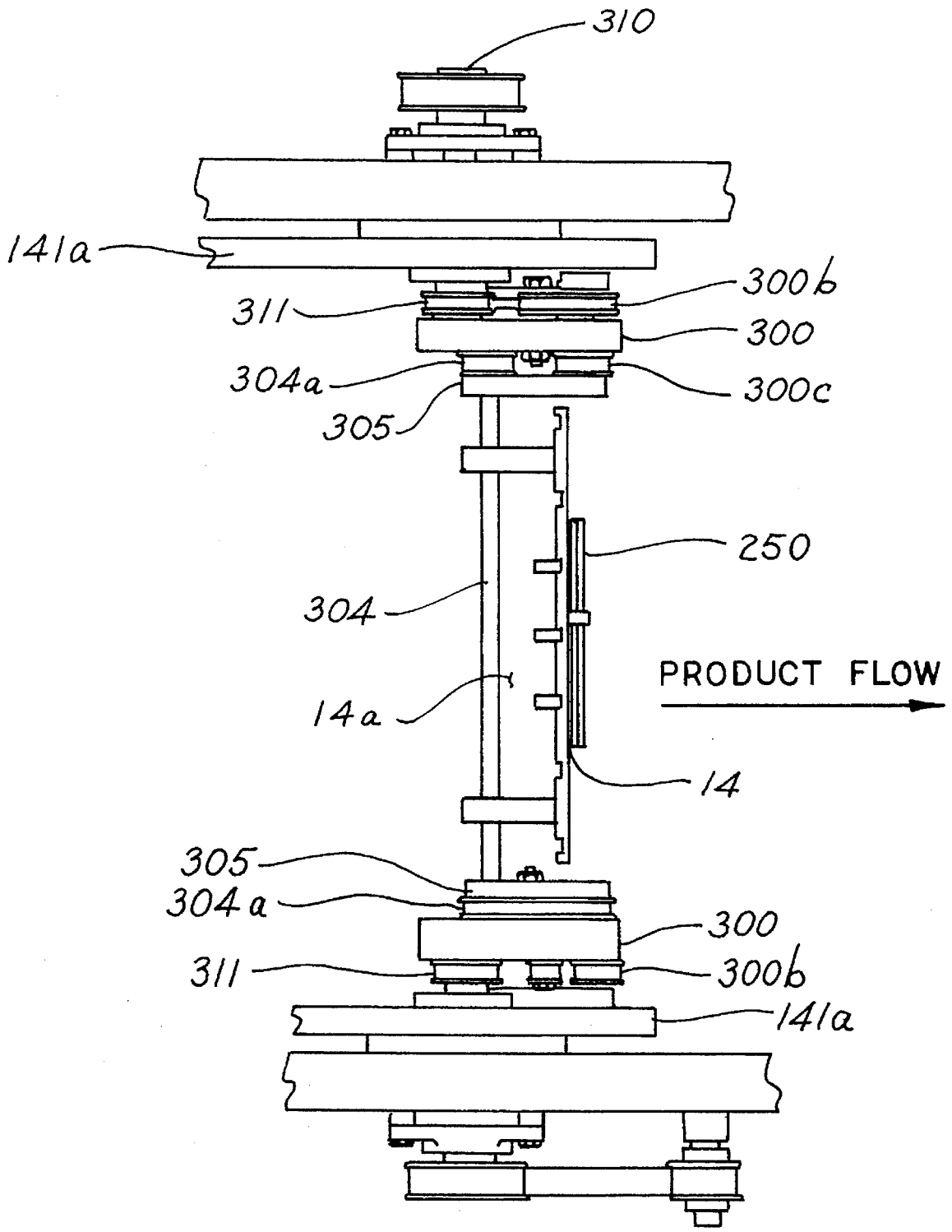
FIG. 23 is a top plan view of the first tail folder assembly for an alternative embodiment of the present invention showing an air tube for blowing out the wrinkles on the first tail of poly film as it is folded.
Figure 24:
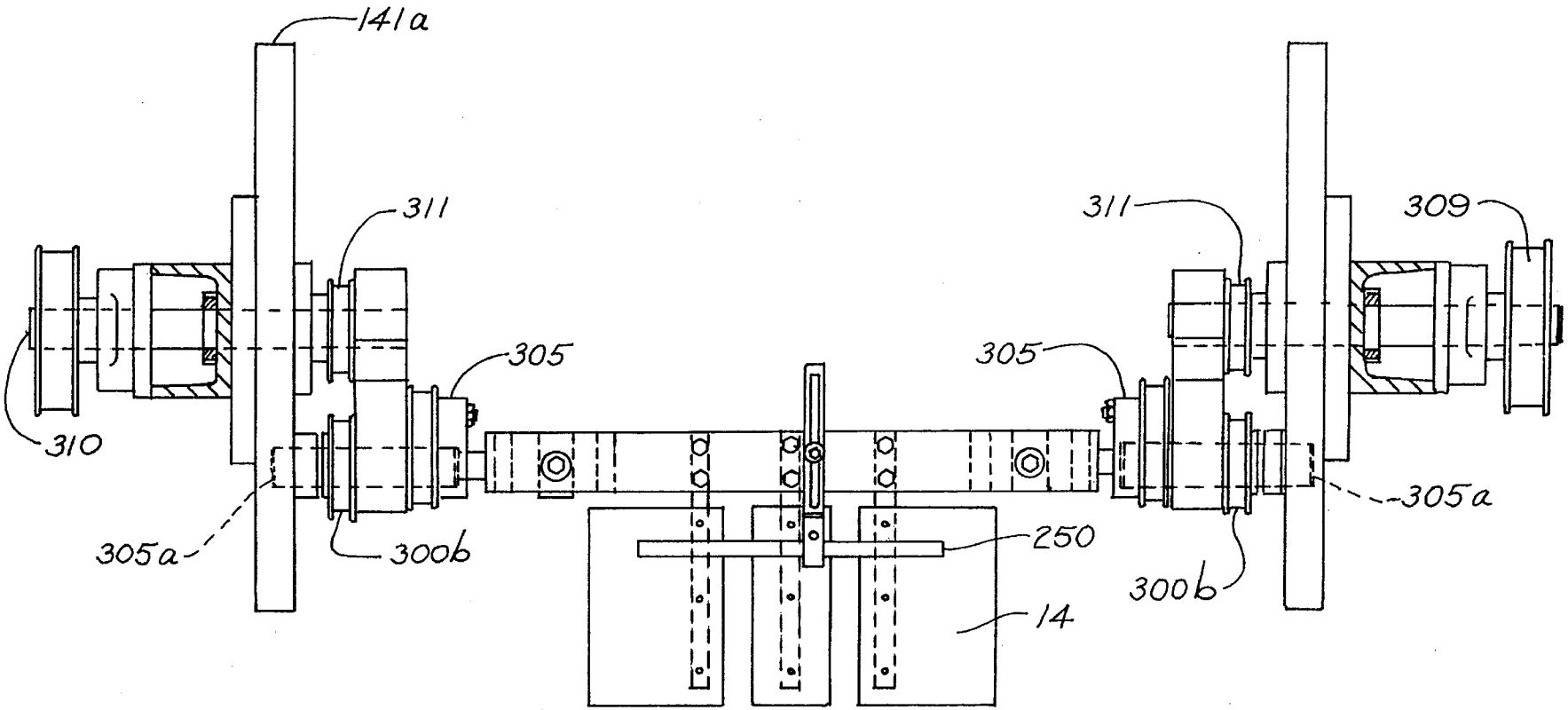
FIG. 24 is an elevational plan view of the first tail folder assembly for an alternative embodiment of the present invention showing an air tube for blowing out the wrinkles on the first tail of poly film as it is folded.

Referring now to FIGS. 21, 23, and 24, pulley 311 is fixed to stationary Cam 141*a* around which crank arm 300 rotates on shaft 310. On the end of crank arm 300 are bearings which support shaft 300*a* onto which pulleys 300*b* and 300*c* are fixed. As crank 300 rotates around fixed pulley 311, motion is transferred to pulley 300*b*, shaft 300*a* , and pulley 300*c* by means of belt 301 and tightener 302. The rotation of crank 300 drags link 305. On the end of link 305 are bearings which support cross shaft 304 onto which pulleys 304*a* are fixed. As link 305 is rotated, motion is transferred to pulley 304*a* and shaft 304 by means of belt 301*a* and tightener 302*a*. Additionally, pulleys 311 and 300*b* must have the same amount of teeth, as well as pulleys 300*c* and 304*a* which also have an equal amount of teeth, or alternatively pulleys 311 and 304*a* must have the same amount of teeth, as well as pulleys 300*b* and 300*c* which also have an equal amount of teeth. By means of the described dual belt and pulley system cross shaft 304, although moving around shaft 310, does not rotate on its axis. Flap folder 14 is fixed to cross shaft 304 by means of support bar system 14*a*. The cam follower 305*a*, which is mounted to link 305, follows in cam track 303 of fixed cam 141*a*. By this means, flap folder 14 attains its desired horizontal and vertical motion. Flap folder 14 is always maintained at the desired angle to the napkins 12; in the present machine 10 that angle is perpendicular to the bed plate of the lower conveyor belts 54 and 52.

Still referring to FIGS. 21–24 but more particularly to FIGS. 21, 23, and 24 the present alternative embodiment may be seen to further include an air bar 250 that is connected to a standard compressed air source. As may be seen in FIG. 21 the air bar 250 blows compressed air down onto the first tail 15 of the poly film 11. This helps to eliminate any wrinkles in the film 11 as it is folded.

Figure 25:
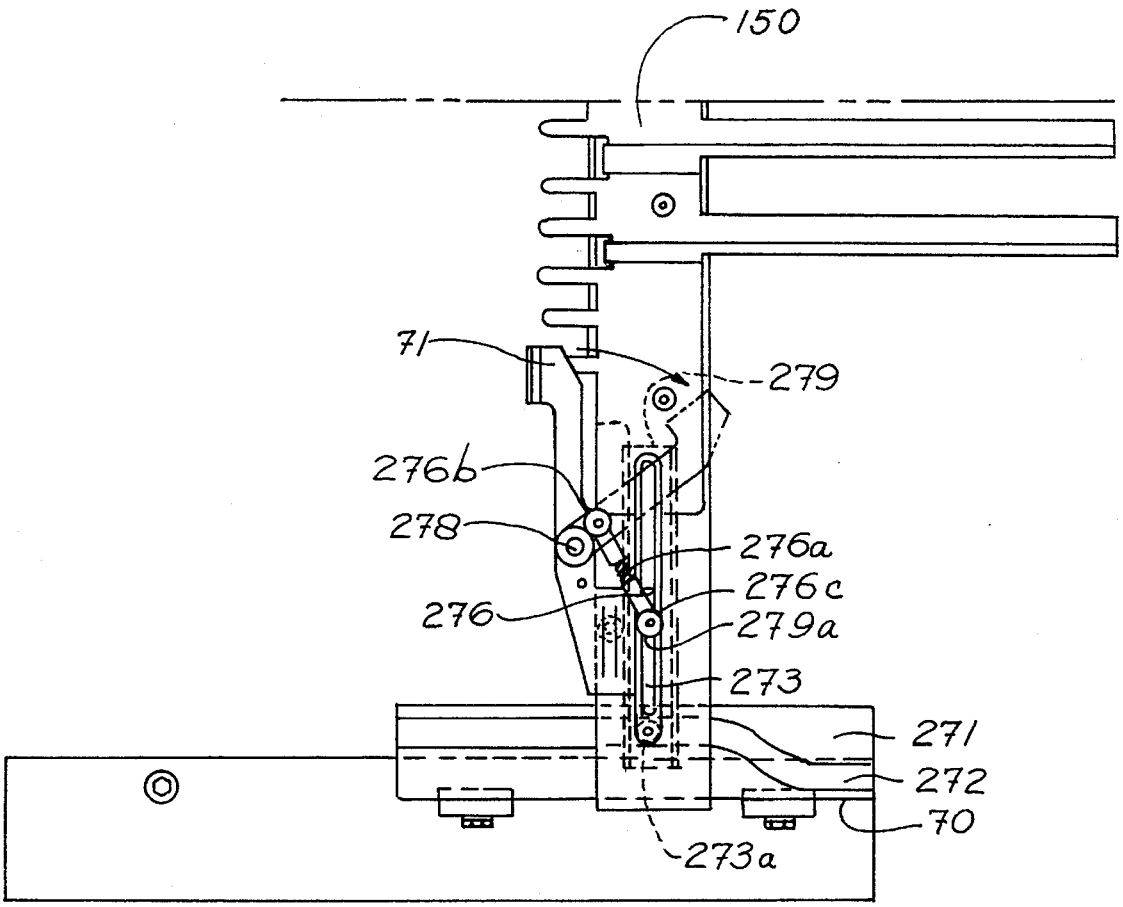
FIG. 25 is a top plan view of the rear sealer bar back up assembly and actuating mechanism for an alternative embodiment of the present invention.
Figure 26:
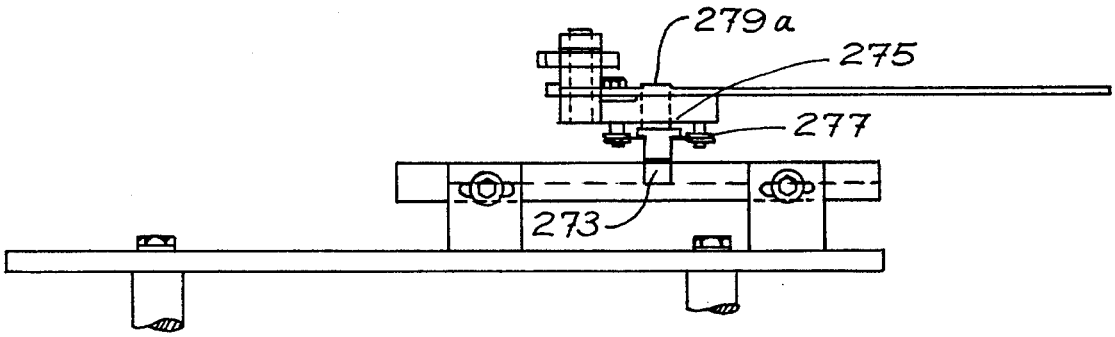
FIG. 26 is an end view of the rear sealer bar back up assembly and actuating mechanism for an alternative embodiment of the present invention.

Finally, the rear seal back up bar assembly 70 may be modified as shown in FIGS. 25 and 26 by eliminating much of the previously disclosed linkage assembly. Essentially the rear seal back up bar assembly 70 may be modified to comprise the back up bar 71 in combination with a fixed cam 271 having a cam track 272 (corresponds to cam track 82) and an actuating mechanism comprising a moveable bar 275, having a slot 273, a rod 276 having a spring 276*a* and two ends 276*b* and 276*c*. End 276*b* is pivotally connected to the back up bar 71 and end 276*c* is pivotally connected in slot 273 of the moveable bar 275. Further, a fixed post 279*a* sits in slot 279 so that bar 275 moves in a fixed direction in response to the travel of cam follower 273*a*, resting in "v" roller guides 277, by means of cam track 272. Accordingly, when the shuttle plate 150 moves, cam follower 273*a* follows cam track 272 thereby moving bar 275. Since rod 276 is pivotally fixed at ends 276*b* and 276*c*, the rod 276 pushes the bar 71 into position. Spring 276*a* allows the bar 71 to resiliently respond to the pressure applied by the heater bar 24. Accordingly, by varying the tension of the spring 276*a* the pressure applied between the heater bar 24 and the bar 71 may be controlled to help ensure good sealing of the rear seam of the poly film 11.

The above described embodiments of this invention are merely descriptive of its principles and are not to be limited. The scope of this invention instead shall be determined from the scope of the following claims, including their equivalents.

What is claimed is:

1. A wrapping machine for wrapping workpieces, the workpieces having a front, back, top, bottom, and sides, the wrapping machine comprising:

a wrapping material wrapping means for partially wrapping a predetermined portion of the wrapping material around the bottom, front, and top of the workpieces;

the predetermined portion of wrapping material having a first tail and a second tail, the first and second tails extending out past the back of the work-pieces;

an infeed means, for infeeding a supply of workpieces into the wrapping material wrapping means, located adjacent to the wrapping material wrapping means;

a sealing station, adjacent to the material wrapping means, including a movable first tail folder means for folding the first tail of the wrapping material against the back of the workpieces, a movable second tail folder means for folding the second tail over the first tail to form a tube, having open ends and a rear seam around the workpieces, a movable rear seam sealing mechanism, a separable conveyor assembly, for continuously conveying the workpieces, having a first belt assembly and a second movable belt assembly adjacent thereto, a timed moving means for moving the second movable belt assembly away from the first belt assembly to form a gap between the first belt assembly and the second movable belt assembly for a predetermined period of time, support means for supporting the second tail folder means and the rear seam sealing mechanism, a first control means for controlling the movement of the first tail folder means, a second control means for controlling the movement of the second tail folder means and the rear seam sealing mechanism through the gap with respect to the support means, and timed actuating means for actuating the rear seam sealing mechanism to seal the rear seam;

the first tail folder means being connected to the first control means;

the second tail folder means and the rear seam sealer mechanism both being connected to the support means and the second control means;

the timed actuating means being connected to the support means and the rear seam sealer mechanism;

a tucker means adjacent to the sealing station, for tucking in the open ends of the tube of the wrapping material around the sides of the workpieces after the rear seam has been sealed;

a sealing means, adjacent to the tucker means, for sealing the ends of the wrapping material against the sides of the workpieces;

the conveyor assembly extending from the wrapping means through the sealing station and the tucker means to the sealing means, whereby the work pieces may be conveyed from the infeed means through the napkin wrapping machine to the sealing means.

2. The wrapping machine for wrapping workpieces of claim 1 in which the separable conveyor assembly having a first belt assembly and a second movable belt assembly comprises:

the first belt assembly being a continuous belt mounted over a first plurality of pulleys;

the second movable belt assembly being a continuous belt mounted over a second plurality of pulleys;

the second plurality of pulleys having a first movable dancer pulley and second movable dancer pulley;

the first dancer pulley being located adjacent to at least one pulley of the first plurality of pulleys;

the timed moving means moving the first and second movable dancer pulleys in tandem so that the first dancer pulley located adjacent to at least one of the first plurality of pulleys moves away from the pulley of the first plurality of pulleys that it is adjacent to and presents the gap between the first dancer pulley and at least one of the first plurality of pulleys;

the second dancer pulley being capable of taking up the slack created in the continuous belt of the second belt assembly by the movement of the first dancer pulley;

the two movable dancer pulleys being connected to the timed moving means.

3. The wrapping machine of claim 2 in which the timed moving means comprises:

a lever linkage assembly having a linkage, a first pivot, a second pivot, a cam, and a cam follower;

the cam follower is mounted to the linkage and engages the cam;

the linkage extending from the first pivot to the second pivot;

the first pivot fixedly connected to the machine;

a connecting means for connecting the first dancer pulley to the second dancer pulley;

the second pivot connecting the connecting means to the linkage; and a driving means for driving the cam at a predetermined rate.

4. The wrapping machine of claim 1 further including:

a backup arm mechanism having a backup arm including a distal end and an proximate end;

the proximate end of the backup arm being mounted to a pivot means for allowing the distal end to pivot about the proximate end in a predetermined path;

the distal end having a backing bar;

the backup arm mechanism being mounted to a timed actuation means, connected to the machine, for actuating the backup arm to pivot about the proximate end along a predetermined path when a tube of wrapping material, having an opened end extending beyond the sides of the workpieces, is present, for a predetermined period of time, in the sealing station.

5. The wrapping machine of claim 4 in which the timed actuation means is an actuation assembly including a first cam follower engaged in a cam, a plurality of interconnected actuation bars having pivots, a mounting bar having a plurality of ears, and a slotted bar having a slot;

a second cam follower being located in the slot and connected to the back up arm mechanism;

the mounting bar being connected to the slotted bar;

at least one pivot of the plurality of pivots being connected to at least one ear of the plurality of ears;

at least one actuation bar being connected to the pivot that is connected to the ear;

the actuation bars being pivotally connected to each other and at least one actuation bar being connected to the first cam follower engaged with the cam;

moving means for moving the first cam follower along the cam.

6. The wrapping machine of claim 1 further including workpiece support means for supporting the front of the workpieces when the rear seam sealer mechanism passes up through the gap.

7. The wrapping machine of claim 6 in which the workpiece support means includes a plurality of workpiece support bars pivotally connected to a slotted block;

the slotted block being pivotally connected to the timed actuating means connected to the support means.

8. The wrapping machine of claim 7 in which timed actuating means are the combination of at least two bell cranks, a cam follower, and a cam;

the bell cranks being pivotally connected to the cam follower;

the cam follower being engaged with the cam;

the cam being movably connected to the second control means.

9. A method of wrapping workpieces using a wrapping machine, the work pieces having a front, back, top, bottom, and sides, the wrapping machine including a wrapping material wrapping means for partially wrapping a predetermined portion of the wrapping material around the bottom, front, and top of the workpieces; the predetermined portion of wrapping material having a first tail and a second tail, the first and second tails extending out past the back of the work-pieces; an infeed means, for infeeding a supply of workpieces into the wrapping material wrapping means, located adjacent to the wrapping material wrapping means; a sealing station, adjacent to the material wrapping means, including a movable first tail folder means for folding the first tail of the wrapping material against the back of the workpieces, a movable second tail folder means for folding the second tail over the first tail to form a tube, having open ends and a rear seam around the work pieces, a movable rear seam sealing mechanism, a separable conveyor assembly having first belt assembly and a second movable belt assembly adjacent thereto, a timed moving means for moving the second movable belt assembly away from the first belt assembly to present a gap between the first belt assembly and the second movable belt assembly for a predetermined period of time, support means for supporting the second tail folder means and the rear seam sealing mechanism, a first control means for controlling the movement of the first tail folder means, a second control means for controlling the movement of the second tail folder means and the rear seam sealing mechanism through the gap with respect to the support means, and timed actuating means for actuating the rear seam sealing mechanism to seal the rear seam; the first tail folder means being connected to the first control means; the second tail folder means and the rear seam sealer mechanism both being connected to the support means and the second control means; the timed actuating means being connected to the support means and the rear seam sealing means; a tucker means adjacent to the sealing station, for tucking in the open ends of the tube of the wrapping material around the sides of the workpieces after the rear seam has been sealed; a sealing means, adjacent to the tucker means, for sealing the ends of the wrapping material against the sides of the workpieces; the conveyor assembly extending from the wrapping means through the sealing station and the tucker means to the sealing means, whereby the work pieces may be conveyed from the infeed means through the napkin wrapping machine to the sealing means, the method comprising the steps of:

feeding the workpieces into the wrapping means and placing a predetermined portion of wrapping material around the workpieces;

the wrapping material having a first tail and a second tail;

continuously moving the workpieces contained in the wrapping material on the conveyor assembly to the sealing station and folding the first tail over the back of the workpieces as the workpieces move from the first belt assembly to the second belt assembly;

separating the second belt assembly from the first belt assembly to form a gap between the first and second belt assemblies;

bringing the second tail folder means and the rear seam sealing means through the gap and folding the second tail over the first tail against the back of the workpieces to form a rear seam and sealing the rear seam;

tucking the open ends of the tube of wrapping material against the sides of the workpieces and then sealing the tucked ends in place.

10. A wrapping machine for wrapping workpieces, the workpieces having a front, back, top, bottom, and sides, the wrapping machine comprising:

a wrapping material wrapping means for partially wrapping a predetermined portion of the wrapping material around the bottom, front, and top of the workpieces;

the predetermined portion of wrapping material having a first tail and a second tail, the first and second tails extending out past the back of the workpieces;

an infeed means, for infeeding a supply of workpieces into the wrapping material wrapping means, located adjacent to the wrapping material wrapping means;

a sealing station, adjacent to the material wrapping means, including a movable first tail folder means for folding the first tail of the wrapping material against the back of the workpieces, a movable second tail folder means for folding the second tail over the first tail to form a tube, having open ends and a rear seam around the workpieces, a movable rear seam sealing mechanism, a separable conveyor assembly, for continuously conveying the workpieces, having a first belt assembly and a second movable belt assembly adjacent thereto, a timed moving means for moving the second movable belt assembly away from the first belt assembly to form a gap between the first belt assembly and the second movable belt assembly for a predetermined period of time, the timed moving means including a lever linkage assembly having a linkage, a first pivot, a second pivot, a first cam, and a first cam follower;

the first cam follower is mounted to the linkage and engages the first cam;

the linkage extending from the first pivot to the second pivot;

the first pivot fixedly connected to the machine;

a connecting means for connecting a first dancer pulley to a second dancer pulley;

the second pivot connecting the connecting means to the linkage;

a driving means for driving the first cam at a predetermined rate;

support means for supporting the second tail folder means and the rear seam sealing mechanism;

a first control means for controlling the movement of the first tail folder means;

a second control means for controlling the movement of the second tail folder means and the rear seam sealing mechanism through the gap with respect to the support means;

and timed actuating means for actuating the rear seam sealing mechanism to seal the rear seam, the timed actuation means being an actuation assembly including a second cam follower engaged in a second cam, a plurality of interconnected actuation bars having pivots, a mounting bar having a plurality of ears, and a slotted bar having a slot;

a third cam follower being located in the slot and connected to the back up arm mechanism;

the mounting bar being connected to the slotted bar;

at least one pivot of the plurality of pivots being connected to at least one ear of the plurality of ears;

at least one actuation bar being connected to the pivot that is connected to the ear;

the actuation bars being pivotally connected to each other and at least one actuation bar being connected to the second cam follower engaged with the second cam;

moving means for moving the second cam follower along the second cam;

the first tail folder means being connected to the first control means;

the second tail folder means and the rear seam sealer mechanism both being connected to the support means and the second control means;

the timed actuating means being connected to the support means and the rear seam sealer mechanism;

a backup arm mechanism having a backup arm including a distal end and an proximate end;

the proximate end of the backup arm being mounted to a pivot means for allowing the distal end to pivot about the proximate end in a predetermined path;

the distal end having a backing bar;

the backup arm mechanism being mounted to the timed actuation means, actuating the backup arm to pivot about the proximate end along a predetermined path when a tube of wrapping material, having an opened end extending beyond the sides of the workpieces, is present, for a predetermined period of time, in the sealing station;

workpiece support means for supporting the front of the workpieces when the rear seam sealer mechanism passes up through the gap, the workpiece support means including a plurality of workpiece support bars pivotally connected to a slotted block;

the slotted block being pivotally connected to the timed actuating means connected to the support means;

a tucker means adjacent to the sealing station, for tucking in the open ends of the tube of the wrapping material around the sides of the workpieces after the rear seam has been sealed;

a sealing means, adjacent to the tucker means, for sealing the ends of the wrapping material against the sides of the workpieces; and the conveyor assembly extending from the wrapping means through the sealing station and the tucker means to the sealing means, whereby the work pieces may be conveyed from the infeed means through the napkin wrapping machine to the sealing means.

11. A wrapping machine for wrapping workpieces, the wrapping machine comprising:

a wrapping material application mechanism capable of applying a predetermined portion of wrapping material partially around a workpiece;

the predetermined portion of wrapping material having a first tail of wrapping material and a second tail of wrapping material substantially extending away from the workpiece;

an infeed supply apparatus capable of supplying workpieces to the wrapping material application mechanism, located substantially adjacent to the wrapping material application mechanism;

a sealing station, located substantially adjacent to the wrapping material application mechanism, having a moveable first tail folder and a moveable second tail folder; the first tail folder and the second tail folder being capable of respectively folding the first and the second tail of wrapping material substantially against the workpiece to substantially form a tube of wrapping material about the workpiece; the tube having open ends and a rear seam; the sealing station further including a moveable rear seam sealer and a separable conveyor assembly, for continuously conveying the workpiece, having a first belt and a second moveable belt adjacent thereto; the sealing station also including a timed moving mechanism capable of moving the first belt away from the second belt to form a gap therebetween for a predetermined period of time, a plurality of control mechanisms capable of controlling the movements of the first tail folder, the second tail folder through the gap, the rear seam sealer through the gap, and a timed actuating mechanism capable of actuating the rear seam sealer at a predetermined time;

the first tail folder, the second tail folder, and the rear seam sealer each being coupled to at least one control mechanism; the timed actuating mechanism being coupled to the rear seam sealer;

a tucker mechanism substantially adjacent to the sealing station, for tucking in the open ends of the tube of the wrapping material around the sides of the workpieces after the rear seam has been sealed;

a sealing apparatus, located substantially adjacent to the tucker mechanism, capable of sealing the ends of the wrapping material against the sides of the workpieces.

12. The wrapping machine for wrapping workpieces of claim 10 further including an air source capable of applying air to at least one of the tails of the wrapping material.

13. The wrapping machine for wrapping workpieces of claim 10 further including an air bar means for applying a blast of air for a predetermined time to the first tail of wrapping material to remove wrinkles from the wrapping material.

14. A method for wrapping workpieces using a wrapping machine for wrapping workpieces having a wrapping material application mechanism; a sealing station, located substantially adjacent to the wrapping material application mechanism, having a moveable first tail folder and a moveable second tail folder; the sealing station further including a moveable rear seam sealer and a separable conveyor assembly, for continuously conveying the workpiece, having a first belt and a second moveable belt adjacent thereto; the sealing station also including a timed moving mechanism capable of moving the first belt away from the second belt to form a gap therebetween for a predetermined period of time, the method comprising:

feeding the workpieces into the wrapping material application mechanism and partially applying a predetermined amount of wrapping material around the workpieces to leave a first tail and second tail of wrapping material;

moving the partially wrapped workpieces on said separable conveyor assembly to the sealing station and folding the first tail against the workpieces;

moving the first belt away from the second belt to form a gap therebetween, moving the second tail folder and the rear seam sealer through the gap and folding the second tail against the workpieces; applying the rear seam sealer to a predetermined portion of the first and second tails and sealing the first and second tails to each other thereby forming the tube of wrapping material around the workpieces;

folding and sealing the ends of the tube so that the workpieces are contained with the wrapping material.

15. A wrapping machine for wrapping napkins, the napkins having a front, back, top, bottom, and sides, the napkin wrapping machine comprising:

an infeed mechanism capable of infeeding a supply of napkins into a wrapping material application apparatus capable of partially wrapping a predetermined portion of wrapping material around the napkins so that a first tail and second tail of the wrapping material is substantially spatially oriented away from the napkins;

a rear seam sealing station, located substantially adjacent to the wrapping material application apparatus, including a first folder capable of folding the first tail of the wrapping material against the napkins, a support structure for supporting a second tail folder capable of folding the second tail against the napkins to form a rear seam, a rear seam sealer capable of substantially sealing the rear seam, a conveyor belt assembly capable of separating to form a gap and a plurality of timed actuating mechanisms for actuating the conveyor belt assembly to form the gap at a predetermined time and actuating the rear seam sealer through the gap to seal the rear seam;

the timed actuating mechanisms being coupled to the support structure, the conveyor belt assembly, and the rear seam sealer;

a tucker, substantially adjacent to the rear seam sealing station, capable of tucking in the ends of the wrapping material around the sides of the napkins after the rear seam has been sealed;

a sealer, located substantially adjacent to the tucker, capable of sealing the ends of the wrapping material against the sides of the napkins.

* * * * *